US010495055B2

(12) United States Patent
Huang

(10) Patent No.: US 10,495,055 B2
(45) Date of Patent: Dec. 3, 2019

(54) LOW-ENERGY AND HIGH PRESSURE, HYDRAULIC, PNEUMATIC ENGINE

(71) Applicant: Jin-Tian Huang, Taitung (TW)

(72) Inventor: Jin-Tian Huang, Taitung (TW)

( * ) Notice: Subject to any disclaimer, the term of this patent is extended or adjusted under 35 U.S.C. 154(b) by 42 days.

(21) Appl. No.: 15/843,083

(22) Filed: Dec. 15, 2017

(65) Prior Publication Data

US 2018/0171965 A1 Jun. 21, 2018

(30) Foreign Application Priority Data

Dec. 21, 2016 (TW) ..... 105142357 A
Sep. 25, 2017 (TW) ..... 106132773 A

(51) Int. Cl.

| | |
|---|---|
| ***F03C 1/06*** | (2006.01) |
| ***F03C 1/40*** | (2006.01) |
| ***F03C 1/04*** | (2006.01) |
| ***F03C 1/12*** | (2006.01) |
| *F04F 1/14* | (2006.01) |

(52) U.S. Cl.

CPC ..... *F03C 1/0692* (2013.01); *F03C 1/0403* (2013.01); *F03C 1/0447* (2013.01); *F03C 1/0607* (2013.01); *F03C 1/0628* (2013.01); *F03C 1/12* (2013.01); *F04F 1/14* (2013.01)

(58) Field of Classification Search

CPC ..... F03B 7/00; F03B 13/264; F03C 1/0692; F03C 1/12; F03C 1/0403; F03C 1/0607; F03C 1/0628

See application file for complete search history.

(56) References Cited

U.S. PATENT DOCUMENTS

| | | | | |
|---|---|---|---|---|
| 4,311,084 A * | 1/1982 | Pierce | F01L 33/02 91/188 |
| 5,261,311 A * | 11/1993 | Cloup | F01L 21/04 60/370 |
| 6,935,294 B1 * | 8/2005 | Kalkstein | F02N 7/08 123/179.16 |
| 2006/0037465 A1 * | 2/2006 | Thierry | F03C 1/03 91/344 |

* cited by examiner

*Primary Examiner* — Abiy Teka

(74) *Attorney, Agent, or Firm* — Alan D. Kamrath; Karin L. Williams; Mayer & Williams PC

(57) ABSTRACT

A low-energy and high pressure, hydraulic, pneumatic engine contains: a casing device, two main-cylinder devices, a holder device, two main-crankshaft devices, two recycle-valve devices, two swing-arm devices, two movable-valve devices, two recycle-cylinder devices, two recycle-crankshaft devices, and two umbrella-shaped gear devices. The engine operates without using gasoline or diesel, thus avoiding discharge of harmful substance or gas and pollution. The high pressure gas forces the hydraulic oil without using gasoline or diesel so as to start the engine, and the hydraulic oil recycles and reuses repeatedly, thus obtaining environmental protection. And the high pressure gas forces the hydraulic oil so as to circulate the hydraulic oil, and the communication of the low-energy and high pressure and the low pressure matches with the circulation space of the fluid operation to produce the torque, hence four strokes cycle of intake, compression, combustion and exhaust are not required.

8 Claims, 19 Drawing Sheets

LOW-ENERGY AND HIGH PRESSURE, HYDRAULIC, PNEUMATIC ENGINE

BACKGROUND OF THE INVENTION

Field of the Invention

The present invention relates to a low-energy and high pressure, hydraulic, pneumatic engine which operates without using gasoline or diesel, thus avoiding discharge of harmful substance or gas and pollution, and the hydraulic oil recycles and reuses repeatedly, thus obtaining environmental protection.

And the high pressure gas forces the hydraulic oil so as to circulate the hydraulic oil, and the communication of the high pressure and the low pressure matches with the circulation space of the fluid operation to produce the torque, hence four strokes cycle of intake, compression, combustion and exhaust are not required.

Description of the Prior Art

A conventional engine structure contains fuel oils (such as gasoline and diesel) used as power source of the conventional engine structure in four strokes cycle of intake, compression, combustion and exhaust so as to drive engine. However, the environmental awareness enhances and the source of the fuel oil will be consumed one day. Thus, searching new energy as power or designing new design is an importance issue.

Another conventional engine contains multiple valve sets so as to provide gas to a cylinder, to press, to burst, and to discharge the gas. Accordingly, the conventional engine is complicated.

The present invention has arisen to mitigate and/or obviate the afore-described disadvantages.

SUMMARY OF THE INVENTION

The primary objective of the present invention is to provide a low-energy and high pressure, hydraulic, pneumatic engine which operates without using gasoline or diesel so as to produce high-pressure gas to act with hydraulic oil, hence four strokes cycle of intake, compression, combustion and exhaust are not required, and power output is finished.

Secondary objective of the present invention is to provide a low-energy and high pressure, hydraulic, pneumatic engine which does not use gasoline or diesel as fuel oil so as to drive the engine and does not discharge any polluted substances, thus obtaining environmental protection.

Further objective of the present invention is to provide a low-energy and high pressure, hydraulic, pneumatic engine which produces liquids between the low-energy and high pressure gas and the hydraulic oil to achieve circulation space of fluid operation, to cause power of circulation of low-energy and high pressure and low pressure and pressure of the low-energy and high pressure, and to turn on of accelerators of recycle cylinders, thus occurring no resistance of force difference so as to produce torque.

Another objective of the present invention is to provide a low-energy and high pressure, hydraulic, pneumatic engine which produces liquids between the low-energy and high pressure gas and the hydraulic oil so as to achieve circulation space of fluid operation and to cause of recycle space of no resistance and circulation space of liquid, thus outputting power source.

DETAILED DESCRIPTION OF THE PREFERRED EMBODIMENTS

Figure 1:
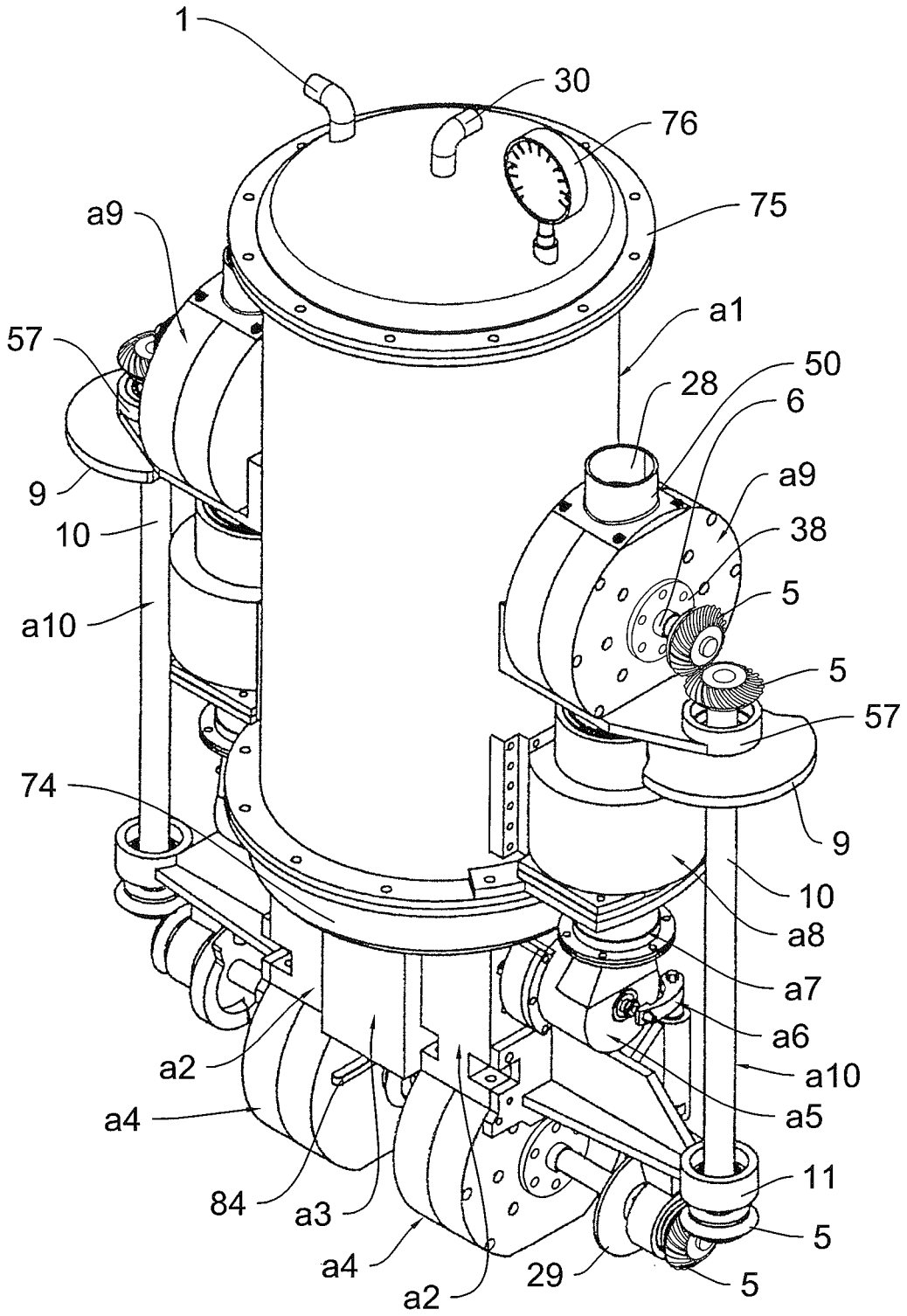
FIG. 1 is a perspective view showing the assembly of a low-energy and high pressure, hydraulic, pneumatic engine in accordance with a preferred embodiment of the present invention.
Figure 2:
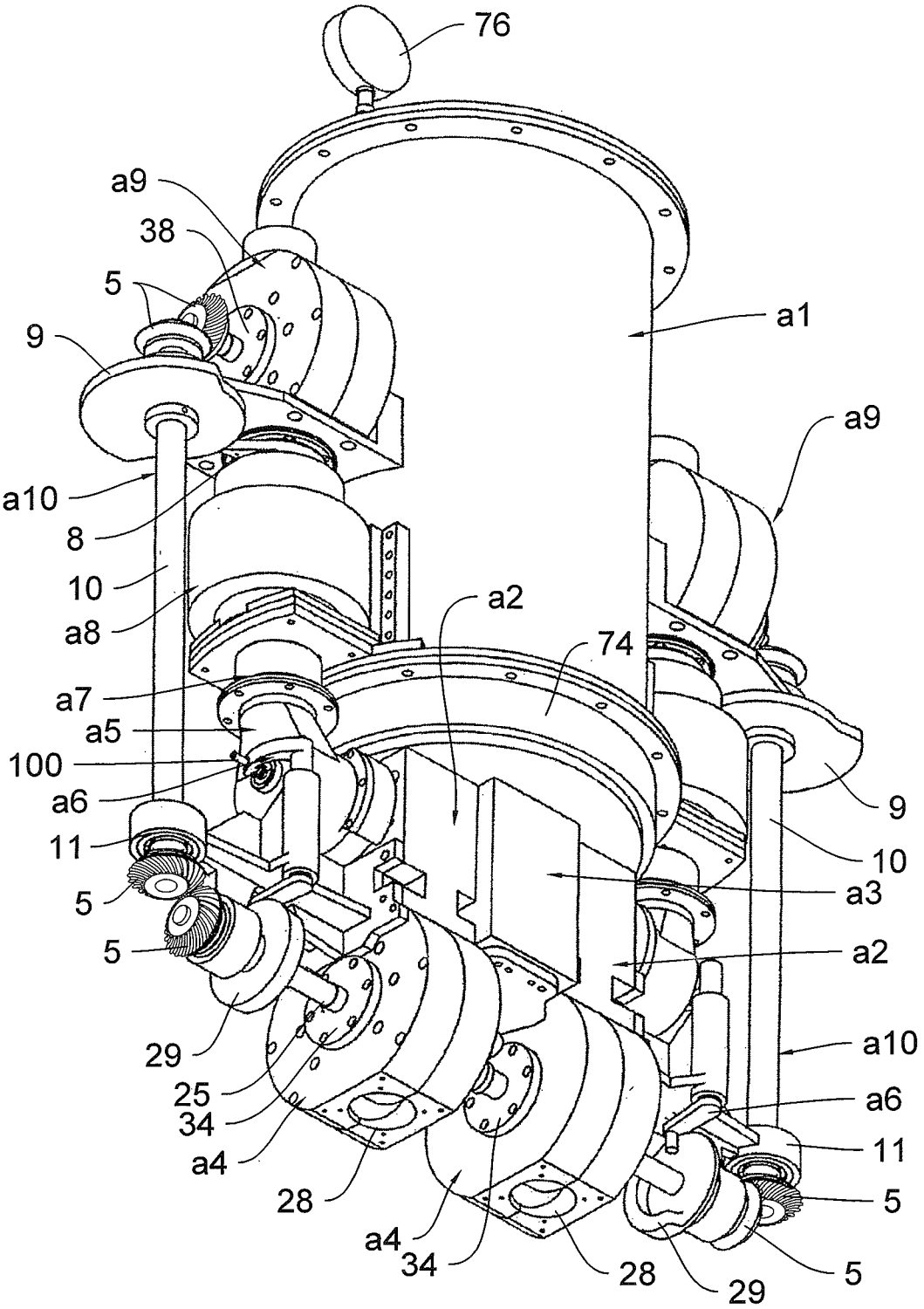
FIG. 2 is another perspective view showing the assembly of the low-energy and high pressure, hydraulic, pneumatic engine in accordance with the preferred embodiment of the present invention.

The present invention will be clearer from the following description when viewed together with the accompanying drawings, which show, for purpose of illustrations only, a preferred embodiment in accordance with the present invention.

With reference to FIGS. 1-4, a low-energy and high pressure, hydraulic, pneumatic engine in accordance with a preferred embodiment of the present invention comprises: a casing device a1, two main-cylinder devices a2, a holder device a3, two main-crankshaft devices a4, two recycle-valve devices a5, two swing-arm devices a6, two movable-valve devices a7, two recycle-cylinder devices a8, two recycle-crankshaft devices a9, and two umbrella-shaped gear devices a10.

Referring to FIGS. 1-4 and 5A, the casing device a1 includes a switch base 74, a switch fitting sleeve 73, a connection tube 72, a switch disc 71, a pressure switch disc 18, a circular partition 17, a pressure rotating disc 16, a pressure rotating base 70, a switch cap 14, a case 26, a pressure disc 27, two movement posts 2, a pressure groove cap 75, a pressure gauge 76, and multiple connecting screws 37, 49. Referring to FIG. 5B, the switch disc 71 has a first groove 7101 defined inside a rim of a side thereof so as to accommodate multiple steel balls 32, and the switch disc 71 has three first orifices 7103 defined on a central position thereof and screwing with three O rings 7102 respectively. As shown in FIG. 5C, the pressure switch disc 18 includes a second groove 1801 defined inside rims of two sides thereof respectively so as to accommodate the multiple steel balls 32, and the second groove 1801 stacks with the first groove 7101 of the switch disc 71; the circular partition 17 has two third grooves 1704 defined inside rims of two sides thereof respectively so as to house the multiple steel balls 32, and the third groove 1704 stacks with the second groove 1801 of the pressure switch disc 18. As shown in FIG. 5D, the pressure rotating disc 16 has two fourth grooves 1601 defined inside rims of two sides thereof individually so as to house the multiple steel balls 32, and the two fourth grooves 1601 stack with the third grooves 1704 of the circular partition 17 individually. As illustrated in FIG. 5E, the pressure rotating base 70 has a fifth groove 7001 defined inside a rim of a side thereof so as to house the multiple steel balls 32, and the fifth groove 7001 stacks with the two fourth grooves 1601 of the pressure rotating disc 16, wherein the pressure rotating disc 16 has a first trough 1602 defined on a central aperture thereof.

With reference to FIGS. 1-4 and 6, each of the two main-cylinder devices a2 includes a main-cylinder 19, a first piston 77, a piston ring 106, and a first bushing 78.

Referring to FIGS. 1-4 and 7, the holder device a3 includes a first coupling shaft 21, a first bearing 82, a first fitting tube 90, a second bearing 91, a third bearing 89, a second fitting tube 88, a fourth bearing 83, a third fitting tube 87, a second coupling shaft 80, a fifth bearing 86, a rotational base 85, a sixth bearing 79, a driving arm 84, a third coupling shaft 20, a first positioning pin 33, a second positioning pin 39, and a first fixing seat 81.

Referring to FIGS. 1-4 and 8, each of the two main-crankshaft devices a4 includes two symmetrical shells 96, two seventh bearings 92, a main-cylinder crankshaft 24, a fourth coupling shaft 25, a first connection rod 94, a first piston pin 95, two oil seals 34, two stop rings 35 retained on the two oil seals 34 respectively, a cylinder cam 29, an eighth bearing 93, and two bevel gears 5.

As shown in FIGS. 1-4 and 9, each of the two recycle-valve devices a5 includes a valve 48, a valve positioning sleeve 43, a C-shaped retainer 44, a valve base 45, a first spring 42, a valve shell 105, a spring upper cap 41, and two crescent retainers 40.

As illustrated in FIGS. 1-4 and 10, each of the two swing-arm devices a6 has a ninth bearing 11, two tenth bearings 98, two eleventh bearings 99, an adjustable screw 100, a straight bearing 31, and each recycle-valve swing-arm 23.

With reference to FIGS. 1-4 and 11, each of the two movable-valve devices a7 includes a second fixing seat 101, two movable valves 12, two second springs 103, a valve pin 102, and a cylinder connecting base 104.

Referring to FIGS. 1-4 and 12, each of the two recycle-cylinder devices a8 includes a first recycle-cylinder base 63, a C-shaped retainer 64, a second bushing 59, two first linear bearings 69, a protective sleeve 67, two thrust bearings 68, an accelerator 61, two O-shaped oil rings 65, an oil tank 97, a second piston 53, two second linear bearings 66, a third positioning pin 62, and a third spring 60.

As shown in FIGS. 1-4 and 13, each of the two recycle-crankshaft devices a9 includes an air vent 28, a first shell 51, two twelfth bearings 52, a first central shaft 6, an auxiliary crankshaft 55, a second connection rod 58, a second shell 54, an oil seal cap 38, a second piston pin 56, and a second recycle-cylinder base 57.

As illustrated in FIGS. 1-4 and 14, each of the two umbrella-shaped gear devices a10 includes two bevel gears 5, two thirteenth bearings 98, a drive cam 9, and a second central shaft 10.

Figure 3:
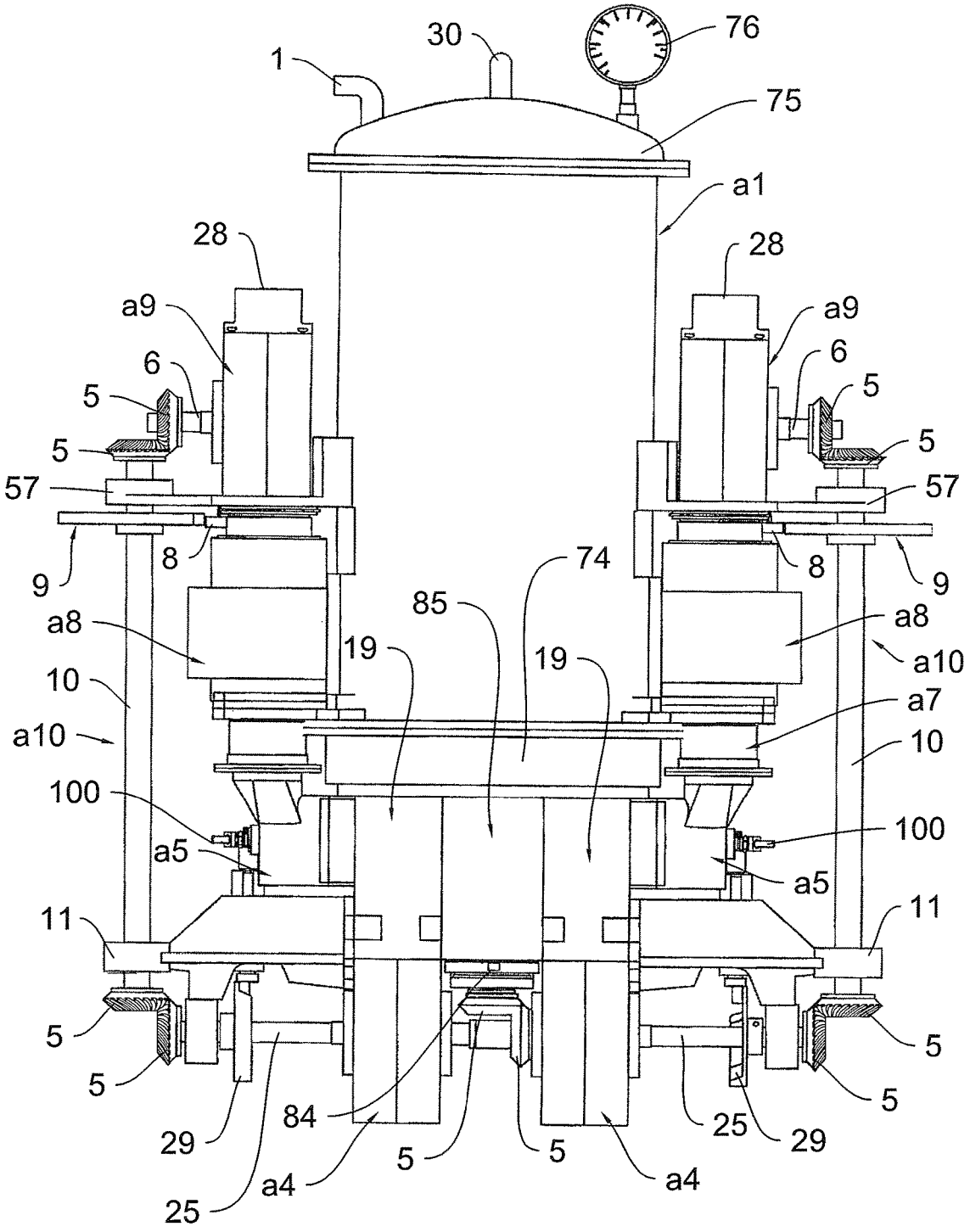
FIG. 3 is a front plan view showing the assembly of the low-energy and high pressure, hydraulic, pneumatic engine in accordance with the preferred embodiment of the present invention.
Figure 4:
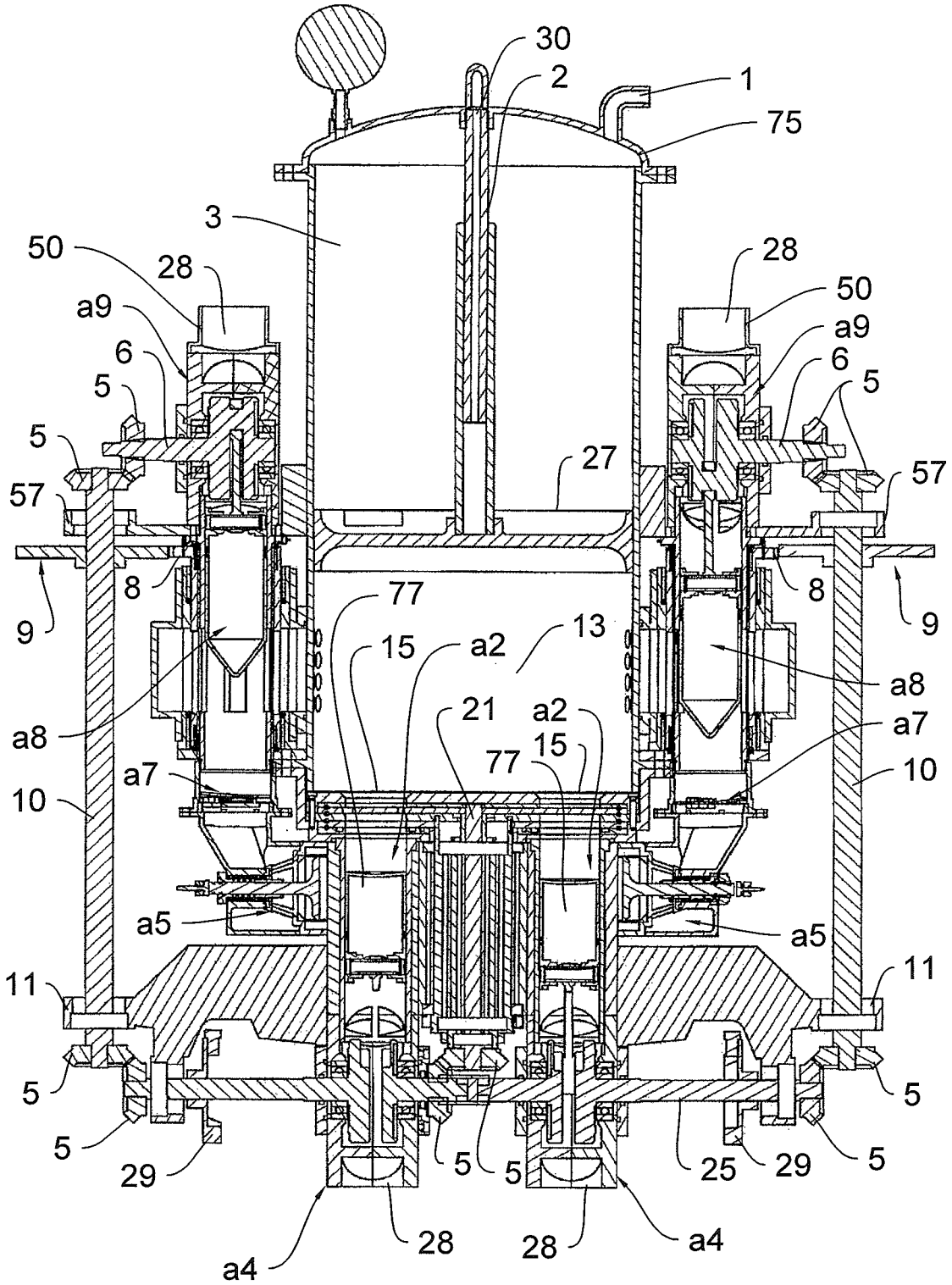
FIG. 4 is a cross sectional view showing the assembly of the low-energy and high pressure, hydraulic, pneumatic engine in accordance with the preferred embodiment of the present invention.
Figure 5A:
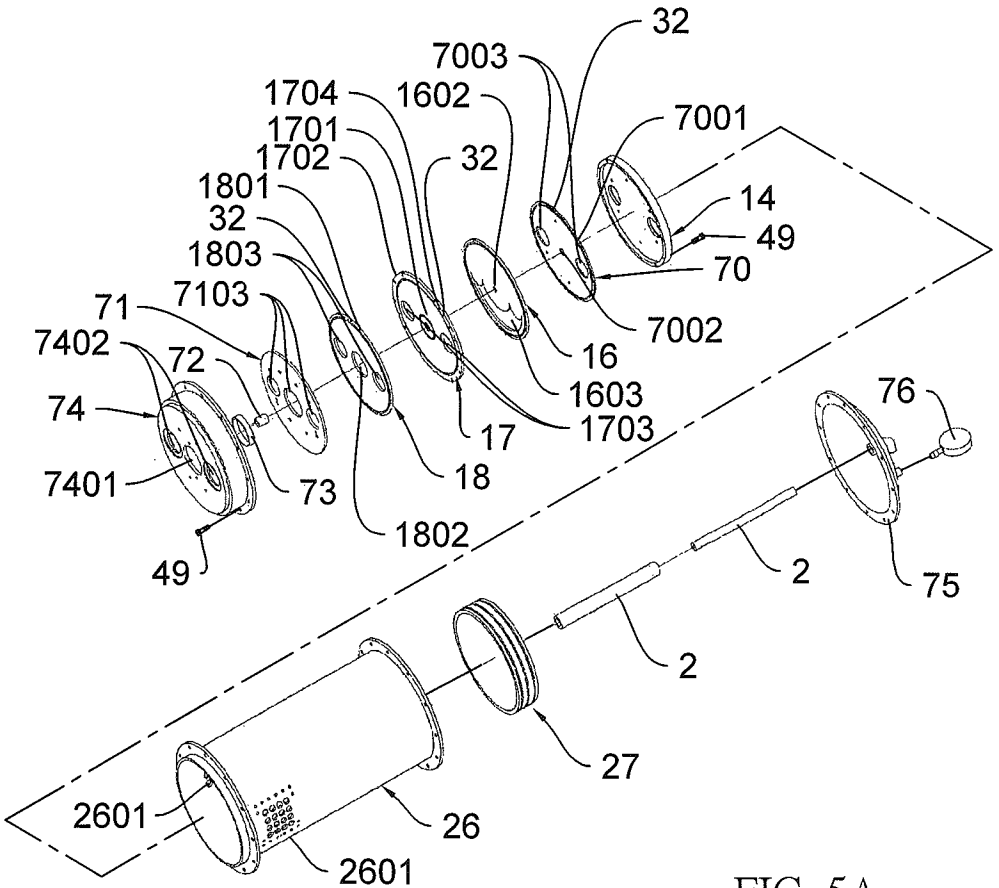
FIG. 5A is a perspective view showing the exploded components of a part of the low-energy and high pressure, hydraulic, pneumatic engine in accordance with the preferred embodiment of the present invention.
Figure 5B:
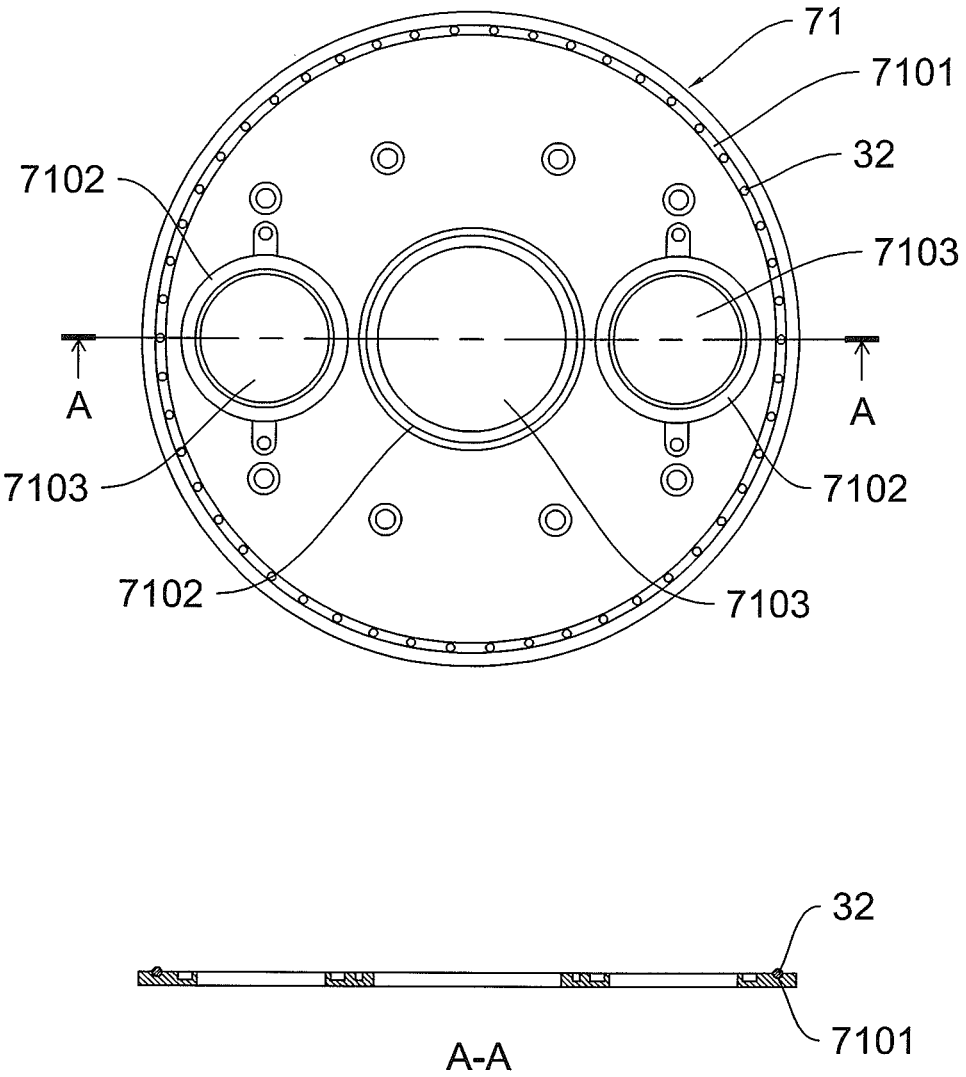
FIG. 5B is a side plan and cross sectional view showing the assembly of a part of the low-energy and high pressure, hydraulic, pneumatic engine in accordance with the preferred embodiment of the present invention.
Figure 5C:
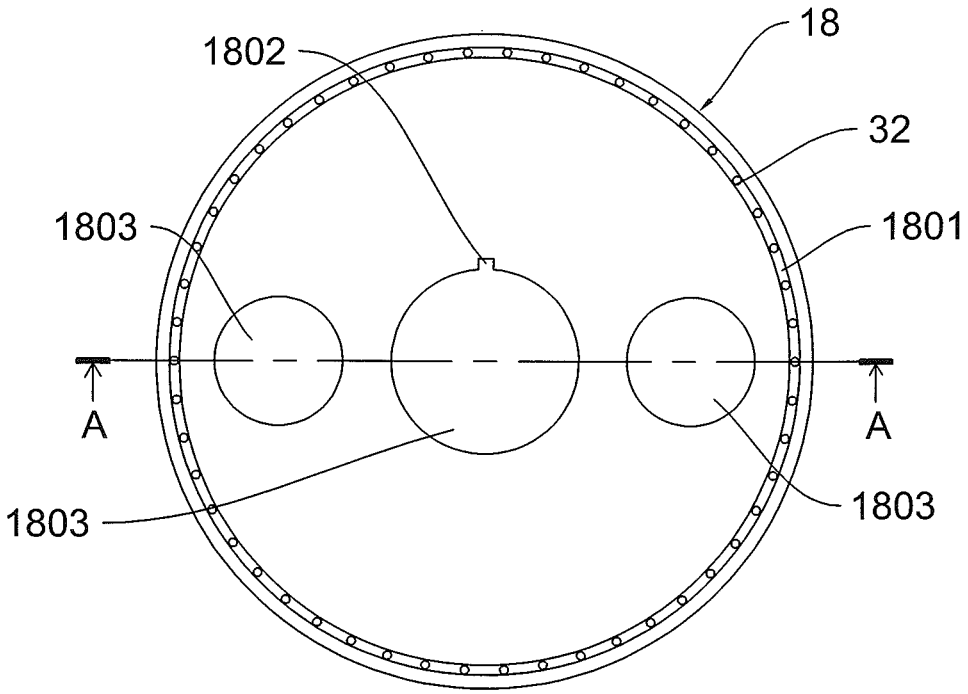
FIG. 5C is another side plan and cross sectional view showing the assembly of a part of the low-energy and high pressure, hydraulic, pneumatic engine in accordance with the preferred embodiment of the present invention.
Figure 5C:
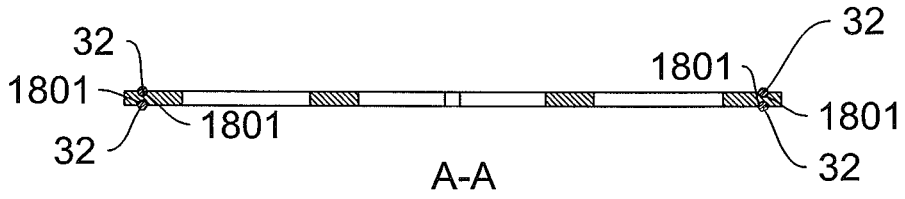
Figure 5D:
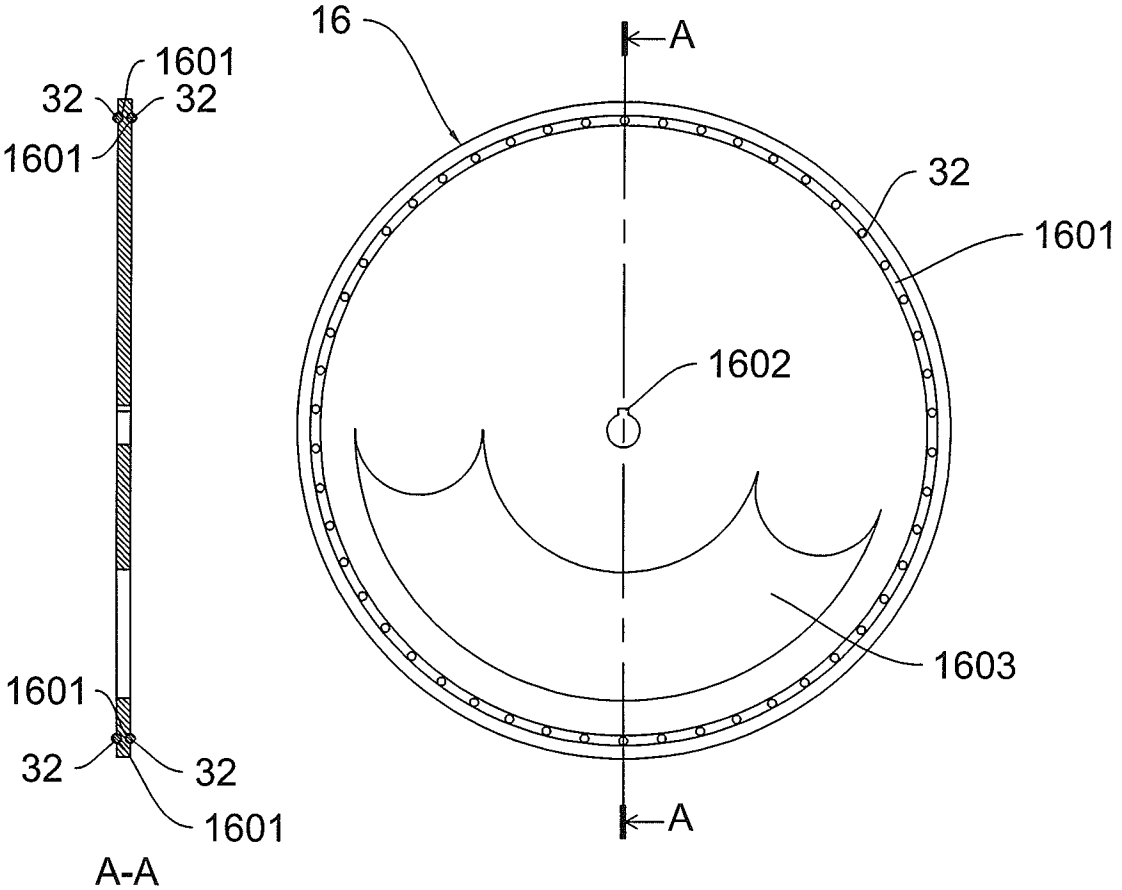
FIG. 5D is also another side plan and cross sectional view showing the assembly of a part of the low-energy and high pressure, hydraulic, pneumatic engine in accordance with the preferred embodiment of the present invention.
Figure 5E:
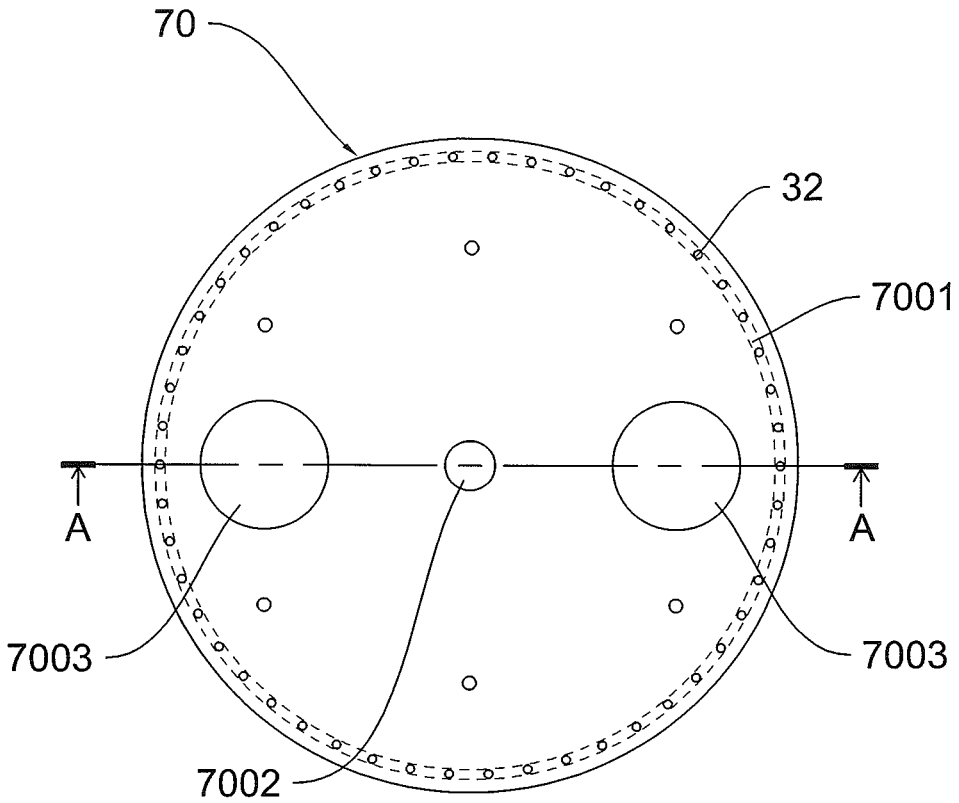
FIG. 5E is still another side plan and cross sectional view showing the assembly of a part of the low-energy and high pressure, hydraulic, pneumatic engine in accordance with the preferred embodiment of the present invention.
Figure 5E:
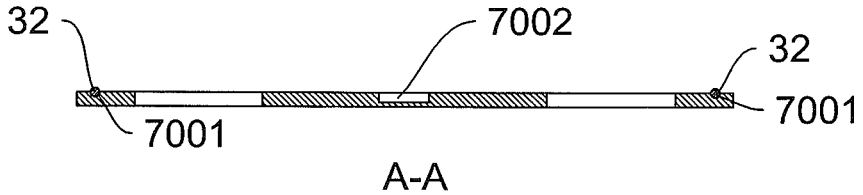
Figure 6:
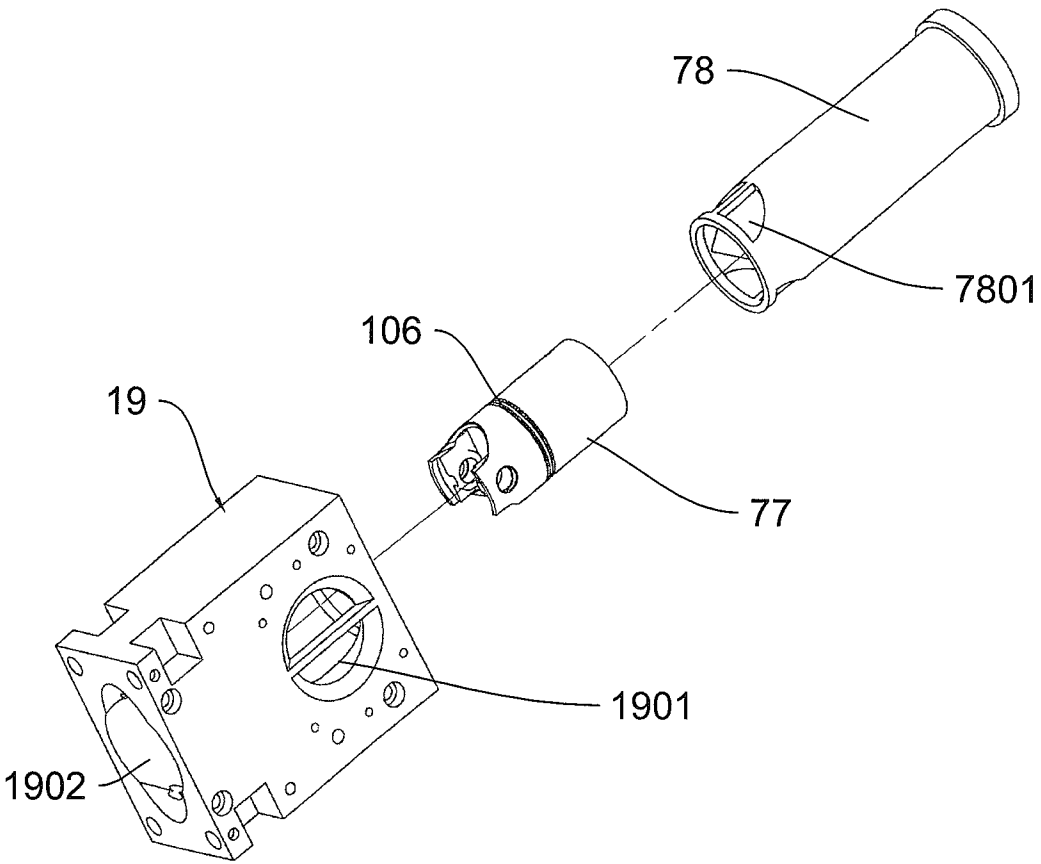
FIG. 6 is a perspective view showing the exploded components of a part of the low-energy and high pressure, hydraulic, pneumatic engine in accordance with the preferred embodiment of the present invention.
Figure 7:
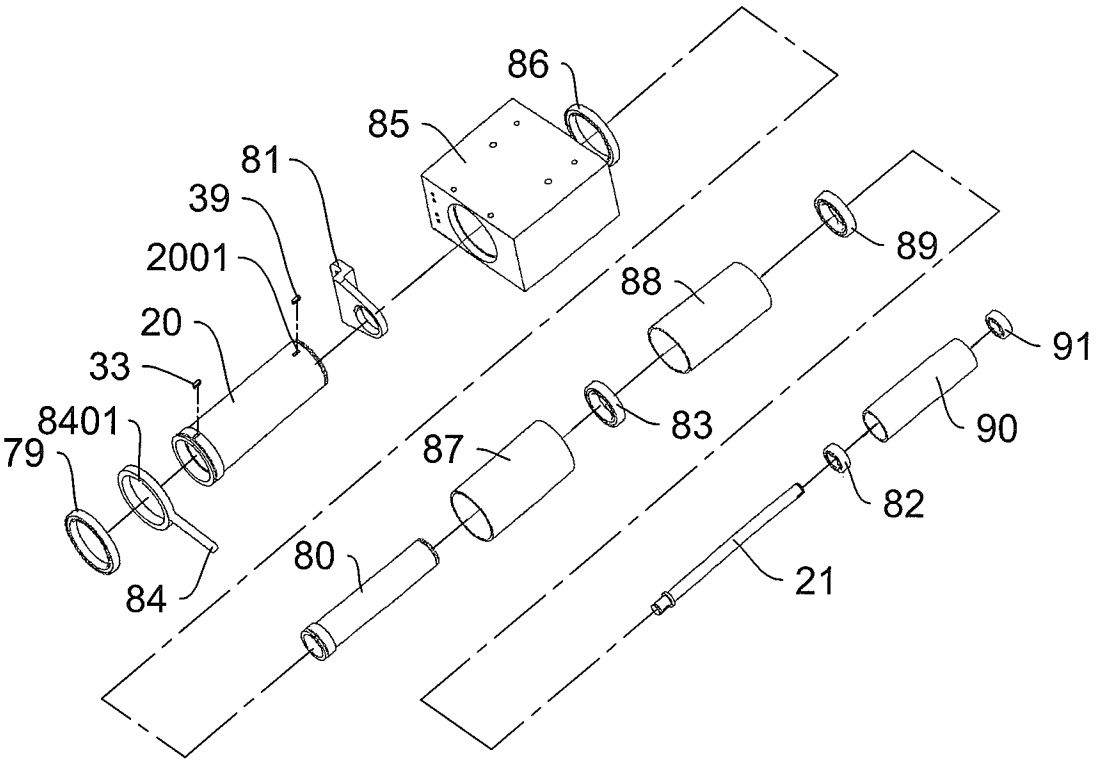
FIG. 7 is another perspective view showing the exploded components of a part of the low-energy and high pressure, hydraulic, pneumatic engine in accordance with the preferred embodiment of the present invention.
Figure 8:
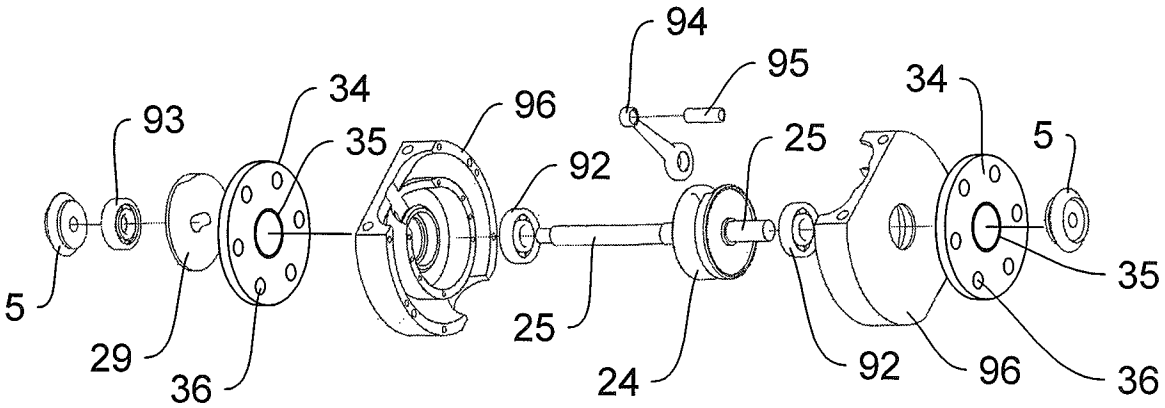
FIG. 8 is also another perspective view showing the exploded components of a part of the low-energy and high pressure, hydraulic, pneumatic engine in accordance with the preferred embodiment of the present invention.
Figure 9:
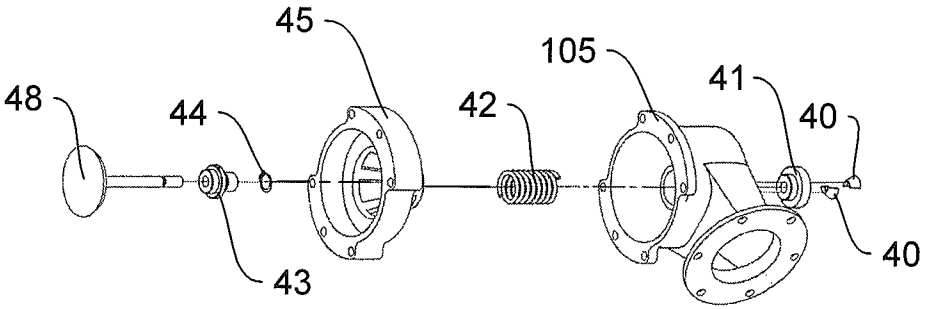
FIG. 9 is still another perspective view showing the exploded components of a part of the low-energy and high pressure, hydraulic, pneumatic engine in accordance with the preferred embodiment of the present invention.
Figure 10:
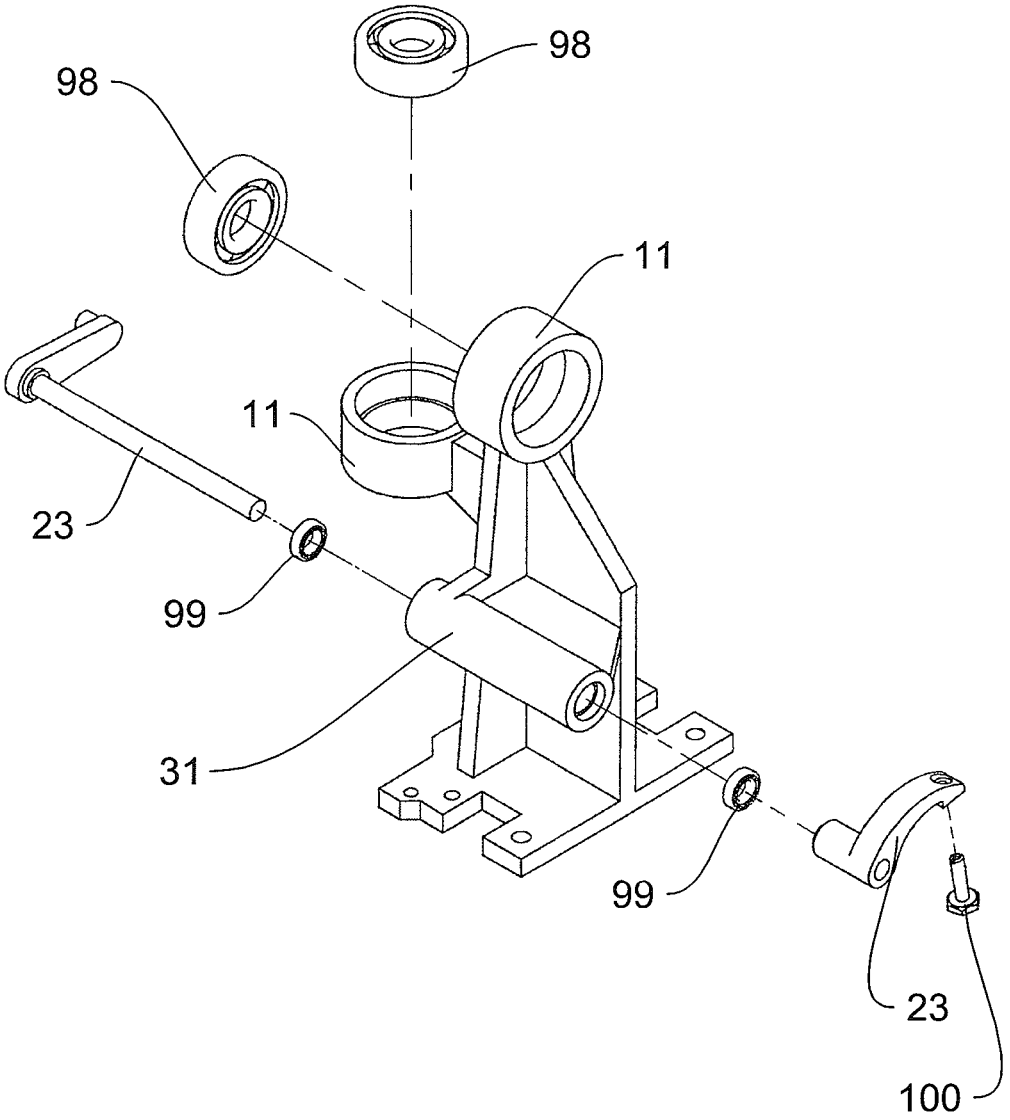
FIG. 10 is another perspective view showing the exploded components of a part of the low-energy and high pressure, hydraulic, pneumatic engine in accordance with the preferred embodiment of the present invention.
Figure 11:
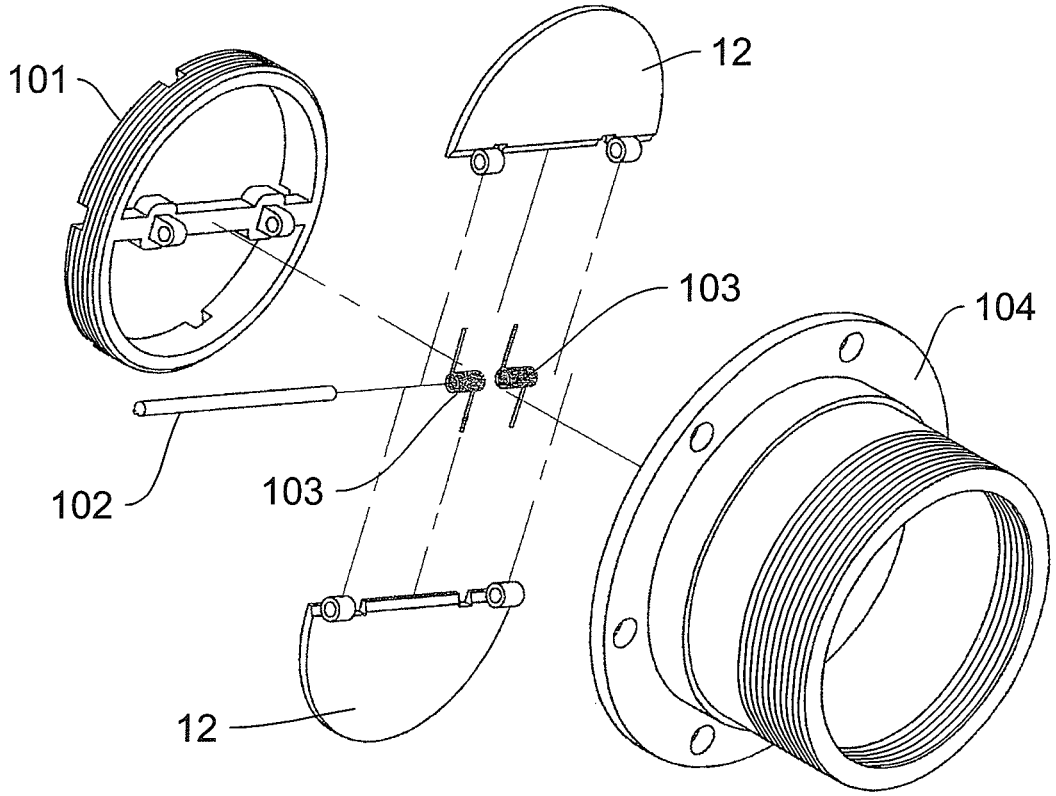
FIG. 11 is also another perspective view showing the exploded components of a part of the low-energy and high pressure, hydraulic, pneumatic engine in accordance with the preferred embodiment of the present invention.
Figure 12:
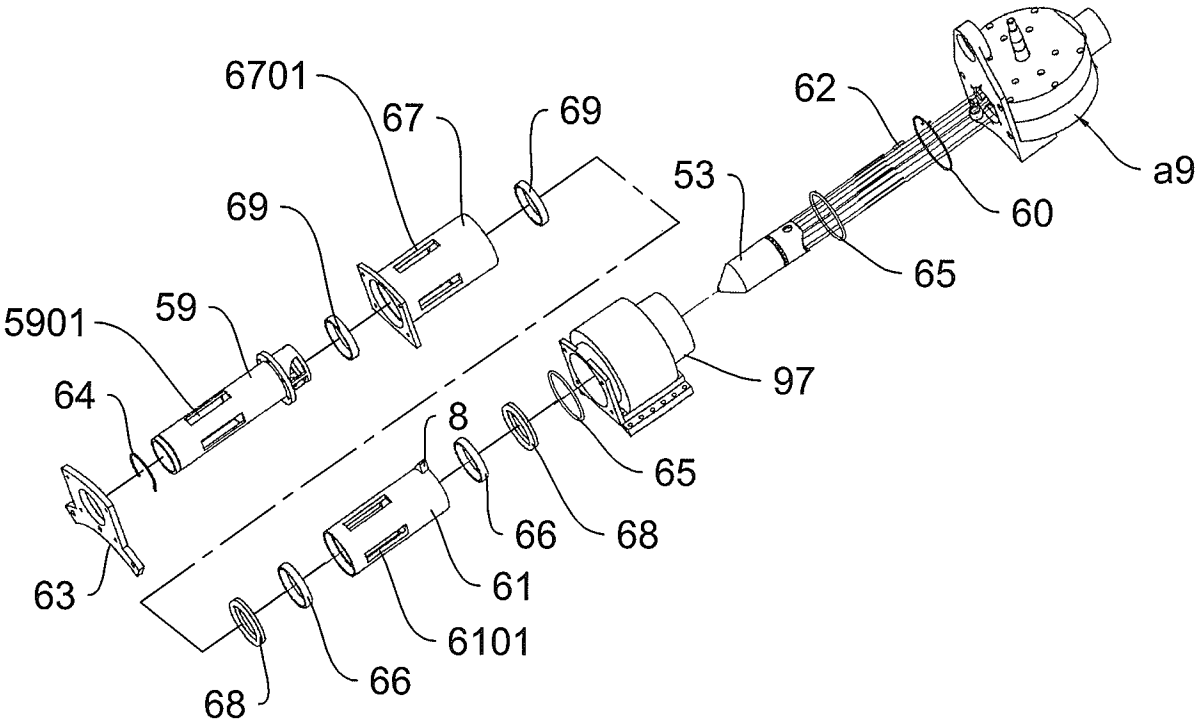
FIG. 12 is still another perspective view showing the exploded components of a part of the low-energy and high pressure, hydraulic, pneumatic engine in accordance with the preferred embodiment of the present invention.
Figure 13:
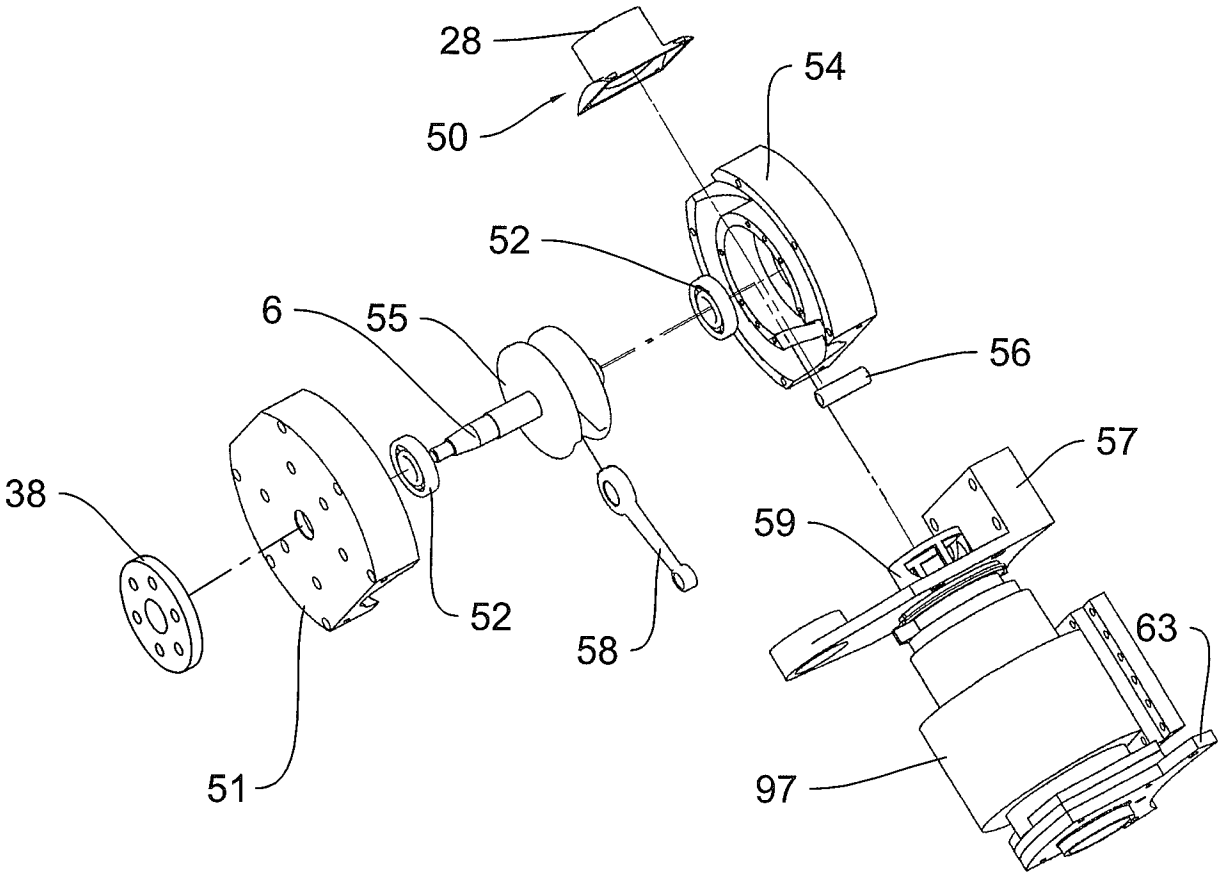
FIG. 13 is another perspective view showing the exploded components of a part of the low-energy and high pressure, hydraulic, pneumatic engine in accordance with the preferred embodiment of the present invention.
Figure 14:
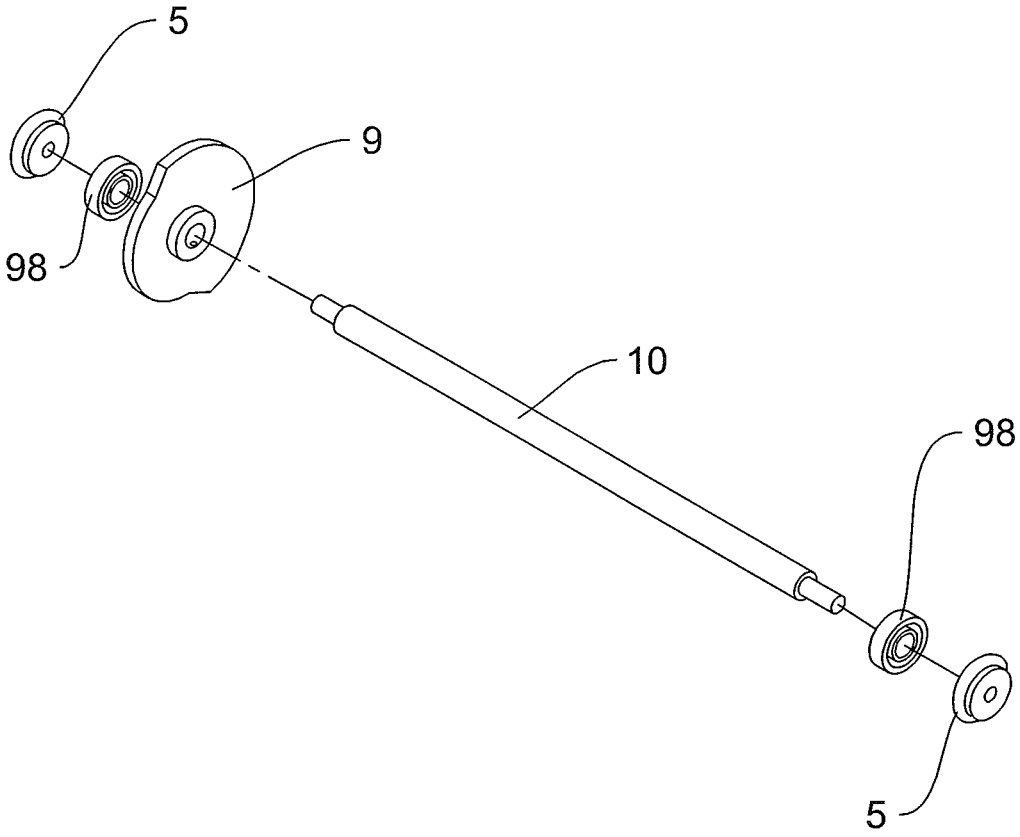
FIG. 14 is also another perspective view showing the exploded components of a part of the low-energy and high pressure, hydraulic, pneumatic engine in accordance with the preferred embodiment of the present invention.

With reference to FIGS. 3 and 4, before assembling the low-energy and high pressure, hydraulic, pneumatic engine, the casing device a1 and multiple first and second connecting screws 37, 49 are connected together, as shown in FIG. 5A. The main-cylinder device a2 is connected as shown in FIG. 6. The holder device a3 is connected together as illustrated in FIG. 7. The two main-crankshaft devices a4 and a plurality of first screws (not shown) are screwed with multiple threaded apertures 36 individually, as illustrated in FIG. 8. The two recycle-valve devices a5 and multiple second screws are joined together, as shown in FIG. 9. The two swing-arm devices a6 are connected together, as shown in FIG. 10. The two movable-valve devices a7 are connected together, as shown in FIG. 11. The two recycle-cylinder devices a8 are coupled together, as illustrated in FIG. 12. The two recycle-crankshaft devices a9 and multiple screws (not shown) are coupled together, as illustrated in FIG. 13. The two umbrella-shaped gear devices a10 are joined together, as shown in FIG. 14.

Figure 15:
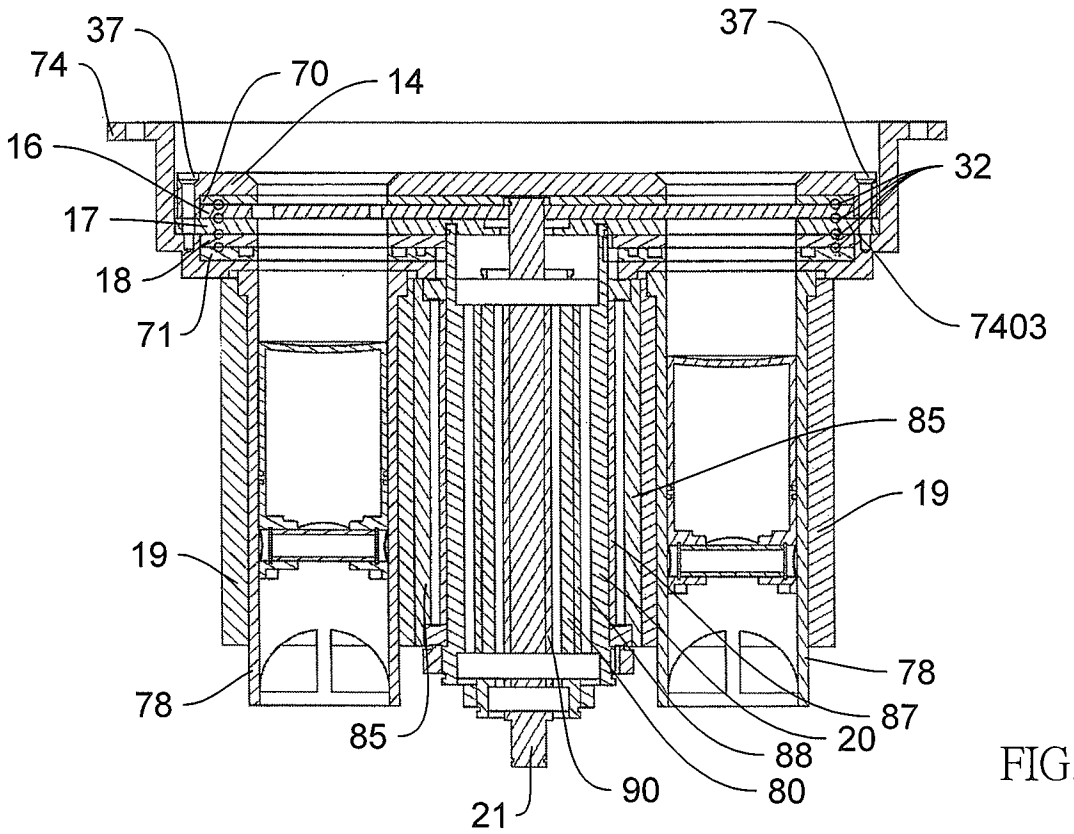
FIG. 15 is a cross sectional view showing the assembly of a part of the low-energy and high pressure, hydraulic, pneumatic engine in accordance with the preferred embodiment of the present invention.

Referring further to FIGS. 1-4 and 5A, two main-cylinder devices a2 are accommodated below the switch base 74 of the casing device a1 and are connected to two fifth orifices 7402 beside two sides of the switch base 74, and two first connection rods 94 of the two main-crankshaft devices a4 (as shown in FIG. 8) are connected with two first pistons 77 of the two main-cylinder devices a2 (as shown in FIG. 6) by way of two first piston pins 95 and multiple screws (not shown) respectively, hence the two main-crankshaft devices a4 are fixed below the two main-cylinder devices a2 individually, two fourth coupling shafts 25 are mounted on central positions of the two main-cylinder crankshafts 24 respectively, and two bevel gears 5 are secured on two ends of the two fourth coupling shafts 25 respectively, wherein one of the two bevel gears 5 (as shown in FIG. 4) is fixed on one of the two fourth coupling shafts 25 located on one surface of a left side of the main-cylinder crankshaft 24. The holder device a3 is defined on a middle portion between the two main-cylinder devices 19 and is connected on the switch base 74 of the casing device a1, as shown in FIGS. 3 and 5A, thereafter the rotational base 85 is screwed in a first central hole 7401 of the switch base 74 (as shown in FIGS. 7 and 15), wherein three connection parts are coupled together in a central position of the rotational base 85, one of the three connection parts is: after the second bearing 91 and the first bearing 82 are housed in two second orifices of two ends of the first fitting tube 90, the first coupling shaft 21 is fitted in the first fitting tube 90; another of the three connection part is: after the third bearing 89 and the fourth bearing 83 are accommodated in two third orifices of two ends of the second fitting tube 88, the second coupling shaft 80 is fitted in the second fitting tube 88; the of the three connection parts is: after the sixth bearing 79 and the fifth bearing 86 are retained in two fourth orifices of two ends of the third fitting tube 87, the third coupling shaft 20 is fitted in the third fitting tube 87. Thereafter, the first connection part is fitted in the second connection part, and the second connection part and the first connection part are fitted in the third connection part, thus assembling central position of the rotational base 85, as shown in FIG. 15. With reference to FIG. 3, the driving arm 84 and the bevel gear 5 extends over the rotational base 85 (as illustrated in FIG. 3), wherein a second troughs 8401 of the driving arm 84 are mounted beside a first side of the third coupling shaft 20 by using the first positioning pin 33 (as shown in FIGS. 5A, 7 and 15), and the third coupling shaft 20 includes a third trough 2001 defined on a second side thereof and retained with the second positioning pin 39, the second side of the third coupling shaft 20 is retained on a fourth trough 1802 of a second central hole 1803 of the pressure switch disc 18 by way of the second positioning pin 39 (as illustrated in FIG. 5C), hence the driving arm 84 rotates to drive the pressure switch disc 18 to rotate through the third coupling shaft 20, and the multiple steel balls 32 around the pressure switch disc 18 (as shown in FIG. 5C) roll to drive the driving arm 84 so that the driving arm 84 rotate the pressure switch disc 18 easily, thus starting the pressure switch disc 18 switch based on using requirements (i.e., the second central hole 1803 of the pressure switch disc 18, the two fifth orifices 7402 of the switch base 74, the first orifice 7103 of the switch disc 71, and a seventh orifice 1703 of the circular partition 17 are at a central axis), or is on an off state (i.e., the second central hole 1803 of the pressure switch disc 18, the two fifth orifices 7402 of the switch base 74, the first orifice 7103 of the switch disc 71, and the seventh orifice 1703 of the circular partition 17 are is on a crossing position of 90 degrees). The bevel gear 5 is connected with the bevel gear 5 on one side of a right-side main-cylinder crankshaft 24, as shown in FIG. 3. Referring to FIGS. 5A and 15, the switch disc 71, the pressure switch disc 18, the circular partition 17, the pressure rotating disc 16, the pressure rotating base 70, and the switch cap 14 are stacked together and are accommodated in the switch base 74 by way of multiple first connecting screws 37 (as shown in FIG. 15). After the switch fitting sleeve 73 is fixed in the first orifice 7103 of the switch disc 71, multiple fifth screws (not shown) screw the switch disc 71 on a bottom of the switch base 74. A protrusion 1702 of the circular partition 17 is screwed on a platform 7403 of the switch base 74 by using the multiple first connecting screws 37 (as shown in FIG. 15). The pressure switch disc 18 rotates between the switch disc 71 and the circular partition 17 (because the multiple steel balls 32 and multiple peripheral grooves are arranged between the switch disc 71 and the pressure switch disc 18, and the switch disc 71 stacks with the pressure switch disc 18). The pressure rotating disc 16 rotates 360 degrees between the circular partition 17 and the pressure rotating base 70. When the holder device a3 is connected on the switch base 74 of the casing device a1, a first end of the first coupling shaft 21 of the rotational base 85 is connected with the bevel gear 5 (as shown in FIG. 3), a second end of the first coupling shaft 21 is connected with the pressure rotating disc 16 by using the connection tube 72 via the switch disc 71, the pressure switch disc 18, and the circular partition 17 and abuts against a slot 7002 on a center of the pressure rotating base 70, hence the first coupling shaft 21 drives the pressure rotating disc 16 to rotate 360 degrees. The two main-cylinder 19 and the rotational base 85 are screwed on the switch base 74 of the casing device a1, wherein the casing device a1 includes other parts (as shown in FIG. 5A) so that when a first end of the casing device a1 is screwed on the switch base 74 by way of the second connecting screws 49, a second end of the casing device a1 accommodates the pressure disc 27 and the two movement posts 2 and is screwed with the pressure groove cap 75, wherein each of the two movement posts 2 has an air hole 30 formed outside the pressure groove cap 75, and the pressure gauge 76 is fixed on one side of the pressure groove cap 75 (as illustrated in FIG. 4). Furthermore, a hydraulic tank 13 is defined in the casing device a1 below the pressure disc 27, and a pressure tank 3 is defined in the casing device a1 above pressure disc 27. The two swing-arm devices a6 are arranged on sides of a lower end of the two main-cylinder devices a2 (as shown in FIGS. 3 and 10), wherein a ninth bearing 11 of the two swing-arm devices a6 is mounted on the second central shaft 10, and the bearing 11 of the two swing-arm devices a6 is fixed on the fourth coupling shaft 25. Each of the two main-cylinder devices a2 has a sixth orifice 1901 defined on one side thereof and connects with each of the two recycle-valve devices a5 (as illustrated in FIGS. 3, 6, and 9), and an outlet end of each recycle-valve device a5 is coupled with each movable-valve device a7 (as shown in FIG. 11). The adjustable screw 100 is located on a right side of each recycle-valve device a5 and has each swing-arm 23, and the each swing-arm 23 corresponds to each recycle-valve device a5 to rotate, wherein each swing-arm 23 intermittently presses and releases the adjustable screw 100 by way of the cylinder cam 29 on each fourth coupling shaft 25. Each movable-valve device a7 is coupled with each recycle-cylinder device a8 (as shown in FIG. 12), and an outlet end of each recycle-cylinder devices a8 is joined with the six body 57 and each recycle-crankshaft device a9 (as illustrated in FIG. 13), wherein the six body 57 is applied to fix the second central shaft 10. Each recycle-crankshaft device a9 has the air vent 28 defined a first end thereof and its right-angle end opposite to the first end connects with a first end of the first central shaft 6, and a second end of the first central shaft 6 is connected with another bevel gear 5 which joins with the umbrella-shaped gear device a10 (as shown in FIG. 14). Each umbrella-shaped gear device a10 includes the drive cam 9 arranged on a top thereof and rotating relative to an operation arm 8 of each recycle-cylinder device a8. Each umbrella-shaped gear device a10 includes another bevel gear 5 arranged on a bottom thereof and connecting with the bevel gear 5 on the two fourth coupling shafts 25.

With reference to FIGS. 1-4, in operation, two operation structures (i.e., a right-side operation structure and a left-side operation structure) opposite to each other form in the low-energy and high pressure, hydraulic, pneumatic engine. The right-side operation structure includes the right-side main-crankshaft devices a4, one of the two main-cylinder devices a2, one of the two fourth coupling shafts 25, one of the two recycle-crankshaft devices a9, one of two first central shafts 6 of the two recycle-crankshaft devices a9, one of the two recycle-cylinder devices a8, one of the two operation arms 8, one of the two movable-valve devices a7, one of the two recycle-valve devices a5, one of the two swing-arm devices a6, one of two cams 9 of the two umbrella-shaped gear devices a10, one of the two umbrella-shaped gear devices a10, and the bevel gear 5. The left-side operation structure includes the left-side main-crankshaft devices a4, the main-cylinder device a2, the fourth coupling shaft 25, the recycle-crankshaft device a9, the first central shaft 6, the recycle-cylinder device a8, the operation arm 8, the movable-valve device a7, the recycle-valve device a5, the swing-arm 23, the drive cam 9, the umbrella-shaped gear device a10, and the bevel gear 5, wherein the right-side operation structure is opposite to the left-side operation structure.

In operation (as shown in FIGS. 1-4) of the right-side operation structure of the low-energy and high pressure, hydraulic, pneumatic engine, the driving arm 84 rotates so as to drive the third coupling shaft 20, and the third coupling shaft 20 actuates the pressure switch disc 18 to revolve so that the second central hole 1803 of the pressure switch disc 18 communicates with one fifth orifice 7402 of the switch base 74, the first orifice 7103 of the switch disc 71, and the seventh orifice 1703 of the circular partition 17 at the same central axis position. In the meantime, high-pressure air inputs into the pressure tank 3 of the case 26 from a pressure aperture 1 so as to push the pressure disc 27 to move downwardly, and the pressure disc 27 forces hydraulic oil in the hydraulic tank 13 to flow downwardly and to push the pressure rotating disc 16 to rotate 360 degrees via first openings of the switch cap 14 and two second through apertures 7003 of the pressure rotating base 70 (as show in FIGS. 5A and 15) so that an eighth orifice 1603 connects with the seventh orifice 1703 of the circular partition 17 (as shown in FIG. 5A), and the hydraulic oil flows into a right-side main-cylinder 19 in FIG. 4. When the first piston 77 in the right-side main-cylinder 19 is located at a highest position (i.e., the piston ring 106 is located below a peripheral side of the sixth orifice 1901) and is about to move downwardly, the pressure rotating disc 16 turns on synchronously so that the hydraulic oil is pushed by the pressure disc 27 to flow into the right-side main-cylinder device a2 of the right-side operation structure via the circular partition 17, the pressure switch disc 18, the switch disc 71, and the switch base 74, hence the first piston 77 in the right-side main-cylinder 19 is driven to move downwardly and to actuate the right-side main-cylinder device a2 to actuate the right-side main-crankshaft device a4 simultaneously, also the right-side main-crankshaft device a4 actuates the fourth coupling shafts 25 to drive the bevel gear 5. Thereafter, the bevel gear 5 drives the first coupling shaft 21 to revolve synchronously and to actuate the pressure rotating disc 16 to rotate 360 degrees.

When the first piston 77 in the right-side main-cylinder device 19 is about to move downwardly, the pressure rotating disc 16 turns on synchronously so that the second piston 53 in the right-side recycle-cylinder device a8 is about to move downwardly from the highest position and is full of the hydraulic oil, and the operation arm 8 of the right-side recycle-cylinder device a8 is driven by the drive cam 9 to turn on, hence the of two accelerators 61 in the right-side recycle-cylinder device a8 turns on (i.e., a first elongate hole 6101 on the accelerate 61, a first elongated hole 6701 of the protective sleeve 67, and a second elongated hole 5901 of the second bushing 59 are at the same position, as shown in FIG. 12).

Thereby, when the pressure rotating disc 16 is about to turn on so that the hydraulic oil flows into the right-side main-cylinder device a2 of FIG. 4, the left-side operation structure opposite to the right-side operation structure operates, for example, the pressure rotating disc 16 on the left-side main-cylinder 19 operates reversely (i.e., the pressure rotating disc 16 turns off), the hydraulic oil does not flow into the left-side main-cylinder device a2, the first piston 77 in the left-side main-cylinder device a2 is located at a lowest position, and the second piston 53 in the right-side recycle-cylinder device a8 is located at the lowest position. In the meantime, the first piston 77 in the left-side main-cylinder device a2 is full of the hydraulic oil, and the accelerator 61 in the recycle-cylinder device a8 turns off after turning on.

Referring to FIGS. 4 and 6, when the first piston 77 in the right-side main-cylinder device a2 descends to the lowest position (the piston ring 106 is located below a ninth orifice 1902) from the highest position (i.e., the piston ring 106 is located below the peripheral side of the sixth orifice 1901), and the pressure disc 27 moves to the lowest position, hence the pressure rotating disc 16 turns off after turning on, and the hydraulic oil in the hydraulic tank 13 flows into the right-side main-cylinder device a2 until the pressure rotating disc 16 turns off. Meantime, the hydraulic oil in the hydraulic tank 13 is isolated completely and does not flow into the right-side main-cylinder device a2, and air in the right-side main-cylinder device a2 discharges out of the air vent 28 because the first piston 77 moves downwardly), hence the first piston 77 moves upward and downward smoothly.

When the first piston 77 in the right-side main-cylinder 19 descends to the lowest position (i.e., the piston ring 106 is located above the ninth orifice 1902) from the highest position (i.e., the piston ring 106 is located below the sixth orifice 1901), the pressure rotating disc 16 turns off. In the meantime, the second piston 53 of the right-side recycle-cylinder device a8 moves to the lowest position from the highest position. During the second piston 53 moves to the lowest position, the accelerator 61 in the right-side recycle-cylinder device a8 turns on because the drive cam 9 drives the operation arm 8, hence the hydraulic oil in the right-side recycle-cylinder device a8 flows into the hydraulic tank 13 via the accelerator 61 and a tenth orifice 2601. Accordingly, when the second piston 53 of the right-side recycle-cylinder device a8 descends to the lowest position from the highest position, the accelerator 61 in the right-side recycle-cylinder device a8 turns off since the drive cam 9 drives the operation arm 8, hence the right-side recycle-cylinder device a8 separates from the hydraulic tank 13, i.e., no resistance occurs in the right-side recycle-cylinder device a8, and the hydraulic oil in the hydraulic tank 13 is stopped flowing back to the right-side recycle-cylinder device a8, such that the hydraulic oil flows into the right-side recycle-cylinder device a8 smoothly in a next stroke.

When the first piston 77 in the right-side main-cylinder device 19 descends to the lowest position (i.e., the piston ring 106 is located above the ninth orifice 1902) from the highest position (i.e., the piston ring 106 is located below the sixth orifice 1901), the pressure rotating disc 16 turns off. In the meantime, the second piston 53 of the recycle-cylinder device a8 and the accelerator 61 descend to the lowest position simultaneously from the highest position, and the first piston 77 of the left-side recycle-cylinder device 7 and the accelerator 61 turn off. Thereafter, the first piston 77 of the left-side main-cylinder device 19 moves to the highest position from the lowest position, meanwhile, the pressure rotating disc 16 turns off so that a second opening 15 is closed. However, the swing-arm 23 operates by using the fourth coupling shaft 25, during the first piston 77 of the lift-side recycle-cylinder 19 lifts upward so that the swing-arm 23 forces the recycle-valve device a5 to turn on. In the meantime, the hydraulic oil in the left-side main-cylinder 19 enters into the left-side recycle-valve device a5 during the first piston 77 moves upward so that the left-side swing-arm 23 forces the left-side recycle-valve device a5 via the cylinder cam 29 of the fourth coupling shaft 25, thus turning on the left-side recycle-valve device a5. In the meantime, the hydraulic oil in the left-side main-cylinder 19 enters into the left-side recycle-valve device a5 during the first piston 77 moves upward so that the hydraulic oil in the left-side main-cylinder 19 produces a pressure to force the left-side movable-valve device a7 of the left-side recycle-valve device a5 to open, hence the hydraulic oil flows into the left-side recycle-cylinder device a8. Meantime, the second piston 53 of the left-side recycle-cylinder device a8 lifts upwardly to the highest position from the lowest position. The airs discharge out of the air vent 28 of a lid 50 so that the second piston 53 moves upward and downward reciprocately. When the second piston 53 lifts upwardly, the airs discharge out of the air vent 28 of a lid 50 so that the second piston 53 moves upward and downward reciprocately. In the meantime, the accelerator 61 of the left-side recycle-cylinder device a8 turns off to as to isolate the pressure so that zero-resistance exists in the left-side recycle-cylinder device a8, and the second piston 53 of the left-side recycle-cylinder device a8 operates and the accelerator 61 turns off after the right-side main-cylinder 19 actuates the left-side main-cylinder crankshaft 24 and the fourth coupling shaft 25 of the right-side main-crankshaft devices a4 to rotate. The bevel gear 5 actuates the left-side second central shaft 10 to drive the left-side cylinder cam 9 so that the left-side operation arm 8 is driven by the left-side cylinder cam 9 to turn off the accelerator 61 of left-side recycle-cylinder device a8, and the left-side second central shaft 10 drives the left-side first central shaft 6 via the bevel gear 5 simultaneously, hence the left-side recycle-crankshaft device a9 drives the second piston 53 of the left-side recycle-cylinder device a8 to move upwardly, and the hydraulic oil in nest stroke flows into the recycle-cylinder device a8 smoothly.

As the first piston 77 of the right-side main-cylinder 19 lifts upward from the lowest position, the pressure disc 27 press downwardly, and the pressure rotating disc 16 turns off.

When the first piston 77 of the right-side main-cylinder device a2 moves upwardly, the pressure rotating disc 16 turns off, the second piston 53 of the right-side recycle-cylinder device a8 lifts upward synchronously, and the accelerator 61 of the right-side recycle-cylinder device a8 turns on.

When the first piston 77 of the right-side main-cylinder device a2 moves upwardly, the pressure rotating disc 16 turns off, hence the left-side operation structure opposite to the right-side operation structure starts operation. For example, the first piston 77 of the left-side main-cylinder device a2 moves downwardly from the highest position (i.e., the piston ring 106 is located below the sixth orifice 1901), and the pressure rotating disc 16 turns on.

When the first piston 77 of the right-side main-cylinder device a2 lifts upward to the highest position, the pressure rotating disc 16 turns off so as to close the right-side second opening 15 and to drive the right-side swing-arm 23. When the first piston 77 of the right-side main-cylinder device a2 lifts upwardly (i.e., the piston ring 106 is located above the ninth orifice 1902), the right-side swing-arm 23 is driven by the cylinder cam 29 to force the right-side recycle-valve device a5 so that the right-side recycle-valve device a5 opens, meanwhile, the hydraulic oil in the right-side main-cylinder device a2 flows into the right-side recycle-valve device a5, when the first piston 77 lifts upwardly, hence the hydraulic oil in the recycle-valve device a5 produces the pressure, and the pressure forces the movable-valve device a7 of the recycle-valve device a5 to open so that the hydraulic oil flows into the right-side recycle-cylinder device a8.

When the first piston 77 of the right-side main-cylinder device a2 lifts upward to the highest position (i.e., the piston ring 106 is located below the sixth orifice 1901) again from the lowest position (i.e., the piston ring 106 is located above the ninth orifice 1902), the pressure rotating disc 16 turns off. In the meantime, the second piston 53 of the right-side recycle-cylinder device a8 moves upwardly from the highest position, and the accelerator 61 of the right-side recycle-cylinder device a8 turns off, wherein the second piston 53 of the right-side recycle-cylinder device a8 operates and the accelerator 61 closes after the right-side main-cylinder device a2 drives the right-side main-crankshaft devices a4, and actuates the fourth coupling shaft 25 of the right-side main-crankshaft devices a4 to revolve, and the bevel gear 5 drives the right-side umbrella-shaped gear device a10 to rotate, and the right-side umbrella-shaped gear device a10 drives the drive cam 9 so that the right-side operation arm 8 is driven by the drive cam 9, so that the accelerator 61 in the right-side recycle-cylinder device a8 turns off, the right-side second central shaft 10 drives the first central shaft 6 by using the bevel gear 5 so that the right-side recycle-crankshaft device a9 actuates the second piston 53 of the right-side recycle-cylinder device a8 to move upward synchronously.

When the first piston 77 of the right-side main-cylinder device a2 lifts upward to the highest position, the pressure rotating disc 16 turns off so that the right-side second opening 15 closes. Thereafter, the first piston 77 of the left-side main-cylinder device a2 descends to the lowest position (i.e., the piston ring 106 is located above the ninth orifice 1902) from the highest position (i.e., the piston ring 106 is located below the sixth orifice 1901), and the pressure rotating disc 16 opens so that the left-side second opening 15 turns on. Meanwhile, the hydraulic oil in the hydraulic tank 13 flows into the left-side main-cylinder device a2 again, hence the left-side operation structure finishes operation in the first stroke.

After the first piston 77 of the right-side main-cylinder device a2 lifts to the highest position (i.e., the piston ring 106 is located below the sixth orifice 1901), the pressure rotating disc 16 is about to turn on, and the right-side swing-arm 23 turns off automatically and simultaneously, the movable-valve device a7 closes automatically and simultaneously so as to stop the right-side main-cylinder device a2 communicating with the recycle-cylinder device a8. Due to the first piston 77 of the right-side main-cylinder device a2 moves to the highest position (i.e., the piston ring 106 is located below the sixth orifice 1901), the hydraulic oil flowing through the right-side recycle-valve device a5 and the right-side movable-valve device a7 is inputted into the recycle-cylinder device a8 by the second piston 53 of the right-side recycle-cylinder device a8 quickly, hence the right-side operation structure finishes operation in the first stroke.

When the first piston 77 of the right-side main-cylinder device a2 operates in a second stroke, i.e., the first piston 77 of the right-side main-cylinder device a2 descends, so that the pressure rotating disc 16 opens to flow the hydraulic oil in the hydraulic tank 13 into the right-side main-cylinder device a2, the second piston 53 of the right-side recycle-cylinder device a8 descends synchronously, wherein the accelerator 61 in the recycle-cylinder device a8 turns on automatically so that the hydraulic oil in the recycle-cylinder device a8 in the first stoke flows back to the hydraulic tank 13 via the tenth orifice 2601.

After the low-energy and high pressure, hydraulic, pneumatic engine operates in turn, four bevel gears 5 on four corners of FIG. 3, connect with the shafts respectively, thus transmitting power and torque of the low-energy and high pressure, hydraulic, pneumatic engine to required operating parts.

Thereby, the low-energy and high pressure, hydraulic, pneumatic engine produces communication of low pressure and low-energy and high pressure, and circulation space of fluid operation, wherein the communication of low pressure and high pressure means behind the symmetrical shell of the first piston and the second shell of the second piston, and include the air vents communicating with a conduit configured to discharge the air, the hydraulic oil is in front of the first and second pistons, so the high pressure is in front of the pistons, and the conduit communicating with the air vents of the cylinders, so the low pressure forms behind the first and second pistons. Wherein the circulation space of the fluid operation represents that when the second piston retracts to the lowest position from the high position, the accelerator is closed so as to isolate the pressure. In the meantime, the recycle-cylinder is in no-pressure state, wherein during the second piston retracts to the lowest position from the high position, the circulation space of the fluid operation produces.

Accordingly, the low-energy and high pressure, hydraulic, pneumatic engine has following advantages:

1. The low-energy and high pressure, hydraulic, pneumatic engine operates without using gasoline or diesel, thus avoiding discharge of harmful substance or gas and pollution.

2. The low-energy and high pressure gas forces the hydraulic oil without using gasoline or diesel so as to start the low-energy and high pressure, hydraulic, pneumatic engine, and the hydraulic oil recycles and reuses repeatedly, thus obtaining environmental protection.

3. The low-energy and high pressure gas forces the hydraulic oil so as to circulate the hydraulic oil, and the communication of the low-energy and high pressure and the low pressure matches with the circulation space of the fluid operation to produce the torque, hence four strokes of intake, compression, combustion and exhaust the air are not required, i.e., burning the fuel oil by using the crankshafts and turning on/off the valves.

4. The low-energy and high pressure, hydraulic, pneumatic engine rotates 360 degrees, the two main-cylinder devices revolves 180 degrees so that the low-energy and high pressure, hydraulic, pneumatic engine operates and switches pressure time, the two main-cylinder devices are in no-pressure state, wherein in the non-switching, the low-energy and high pressure, hydraulic, pneumatic engine rotates in the low-energy and high pressure.

5. The low-energy and high pressure, hydraulic, pneumatic engine starts/stops operation by turning on the driving arms.

While various embodiments in accordance with the present invention have been shown and described, it is clear to those skilled in the art that further embodiments may be made without departing from the scope of the present invention.

What is claimed is:

1. A low-energy and high pressure, hydraulic, pneumatic engine comprising: a casing device, a right-side main-cylinder device and a left-side main-cylinder device, a holder device, a right-side main-crankshaft device and a left-side main-crankshaft device, a right-side recycle-valve device and a left-side recycle-valve, a right-side swing-arm device and a left-side swing-arm device, a right-side movable-valve device and a left-side movable- valve device, a right-side recycle-cylinder device and a left-side recycle-cylinder device, a right-side recycle-crankshaft device and a left-side recycle-crankshaft device, and a right-side umbrella-shaped gear device and a left-side umbrella-shaped gear device; wherein the casing device includes a switch base, a switch fitting sleeve, a connection tube, a switch disc, a pressure switch disc, a circular partition, a pressure rotating disc, a pressure rotating base, a switch cap, a case, a pressure disc, two movement posts, a pressure groove cap, a pressure gauge, and multiple connecting screws, wherein the switch disc has a first groove defined inside a rim of a side thereof so as to accommodate multiple steel balls, and the switch disc has three first orifices defined on a central position thereof and screwing with three O rings respectively; the pressure switch disc includes a second groove defined inside rims of two sides thereof respectively so as to accommodate the multiple steel balls, and the second groove stacks with the first groove of the switch disc; the circular partition has two third grooves defined inside rims of two sides thereof respectively so as to house the multiple steel balls, and the third groove stacks with the second groove of the pressure switch disc; the pressure rotating disc has two fourth grooves defined inside rims of two sides thereof individually so as to house the multiple steel balls, and the two fourth grooves stack with the third grooves of the circular partition individually; the pressure rotating base has a fifth groove defined inside a rim of a side thereof so as to house the multiple steel balls, and the fifth groove stacks with the two fourth grooves of the pressure rotating disc, the pressure rotating disc has a first trough defined on a central position thereof;

each of the right-side main-cylinder device and the left-side main-cylinder device includes a main-cylinder, a first piston, a piston ring, and a first bushing, wherein the right-side main-cylinder device and the left-side main-cylinder device are accommodated below the switch base of the casing device and are connected to two fifth orifices beside two sides of the switch base;

the holder device includes a first coupling shaft, a first bearing, a first fitting tube, a second bearing, a third bearing, a second fitting tube, a fourth bearing, a third fitting tube, a second coupling shaft, a fifth bearing, a rotational base, a sixth bearing, a driving arm, a third coupling shaft, a first positioning pin, a second positioning pin, and a first fixing seat, wherein the holder device is defined on a middle portion between the right-side main-cylinder device and the left-side main-cylinder device and is connected on the switch base of the casing device, thereafter the rotational base is screwed in a first central hole of the switch base;

each of the right-side main-crankshaft device and the left-side main-crankshaft device includes two symmetrical shells, two seventh bearings, a main-cylinder crankshaft, a fourth coupling shaft, a first connection rod, a first piston pin, two oil seals, two stop rings retained on the two oil seals respectively, a cylinder cam, an eighth bearing, and two bevel gears, wherein two first connection rods of the right-side main-crankshaft device and the left-side main-crankshaft device are connected with two first pistons of the right-side main-cylinder device and the left-side main-cylinder device by way of two first piston pins respectively, hence the right-side main-crankshaft device and the left-side main-crankshaft device are fixed below the right-side main-cylinder device and the left-side main-cylinder device respectively, two fourth coupling shafts are mounted on central positions of the right-side main-crankshaft device and the left-side main-crankshaft device respectively, and two bevel gears are secured on two ends of the two fourth coupling shafts respectively, wherein one of the two bevel gears is fixed on one of the two fourth coupling shafts located on one surface of a side of each of the right-side main-crankshaft device and the left-side main-crankshaft device;

each of the right-side recycle-valve device and left-side recycle-valve device includes a valve, a valve positioning sleeve, a C-shaped retainer, a valve base, a first spring, a valve shell, a spring upper cap, and two crescent retainers, wherein each of the right-side main-cylinder device and the left-side main-cylinder device has a sixth orifice defined on one side thereof and connects with the right-side recycle-valve device and the left-side recycle-valve device respectively;

each of the right-side swing-arm device and left-side swing-arm device has a ninth bearing, two tenth bearings, two eleventh bearings, an adjustable screw, a straight bearing, and a recycle-valve swing-arm, wherein the right-side swing-arm device and left-side swing-arm device are arranged on sides of a lower end of the right-side main-cylinder device and the left-side main-cylinder device, a first end of the ninth bearing of each of the a right-side swing-arm device and left-side swing-arm device is mounted on the a second central shaft, and a second end of the ninth bearing of the right-side swing-arm device and left-side swing-arm device is fixed on the fourth coupling shaft, the adjustable screw is located on a right side of each of the right-side recycle valve device and the left-side recycle-valve device and the right-side swing-arm device and the left-side swing arm device each correspond to the right-side recycle-valve device and the left-side recycle-valve device to rotate, wherein the left-side swing arm device and the right-side swing-arm device intermittently press and release the corresponding adjustable screw by way of the cylinder cam on each fourth coupling shaft;

each of the right-side movable-valve device and the left-side movable-valve device includes a second fixing seat, two movable valves, two second springs, a valve pin, and a cylinder connecting base, wherein the right-side movable-valve device and the left-side movable-valve device is coupled with an outlet end of the right-side recycle-cylinder device and the left-side recycle-cylinder device;

each of the right-side recycle-cylinder device and left-side recycle-cylinder device includes a first recycle-cylinder base, a C-shaped retainer, a second bushing, two first linear bearings, a protective sleeve, two thrust bearings, an accelerator, two O-shaped oil rings, an oil tank, a second piston, two second linear bearings, a third positioning pin, and a third spring, wherein the right-side recycle-cylinder device and the left-side recycle-cylinder device is coupled with the right-side movable-valve device and the left-side movable-valve device respectively;

each of the right-side recycle-crankshaft device and left-side recycle-crankshaft device includes an air vent, a first shell, two twelfth bearings, a first central shaft, an auxiliary crankshaft, a second connection rod, a second shell, an oil seal cap, a second piston pin, and a second recycle-cylinder base, wherein the right-side recycle-crankshaft device and the left-side recycle-crankshaft device are fixed on the right-side recycle-cylinder device and the left-side recycle-cylinder device, respectively;

each of the right-side umbrella-shaped gear device and left-side umbrella-shaped gear device includes two bevel gears, two thirteenth bearings, a drive cam, and a second central shaft, wherein one of the two bevel gears on a top of the right-side umbrella-shaped gear device and the left-side umbrella-shaped gear device is connected with and rotates relative to one bevel gear of the first central shaft of the auxiliary crankshaft of the right-side recycle-crankshaft device and the left-side recycle-crankshaft device, and the respective drive cam is connected with and rotates relative to a right-side operation arm and a left-side operation arm, respectively, of the right-side recycle-cylinder device and the left-side recycle-cylinder device, respectively, and each right-side umbrella-shaped gear device and left-side umbrella-shaped gear device includes one of the two second bevel arranged on a bottom thereof and connecting with one of the two bevel gears on one of the two fourth coupling shafts;

thereby inputting high pressure gas in a pressure tank forces hydraulic oil in a hydraulic tank, the hydraulic oil controlled intermittently by the pressure rotating disc so as to drive the right-side main-cylinder device and the right-side main-crankshaft device of a right-side operation structure, wherein the right-side recycle-valve swing-arm pushes the right-side recycle-valve device to actuate the hydraulic oil in the right-side main-cylinder device to produce pressure via the right-side recycle-valve device to automatically open the right-side movable-valve device, and when preparing to flow into the right-side recycle-cylinder device, the right-side recycle-crankshaft device, the first central shaft, the right-side umbrella-shaped gear device and the left-side umbrella-shaped gear device act to drive the respective drive cam to rotate the respective operation arm and to close the accelerator of the right-side recycle-cylinder and the left-side recycle cylinder device, wherein oil pressures between the right-side recycle cylinder and the hydraulic tank are isolated to produce zero resistance, wherein the second piston of the right-side recycle-cylinder device moves upward simultaneously so that the hydraulic oil moves into the right-side recycle cylinder device with zero resistance, after the auxiliary crankshaft, the first central shaft, the umbrella gear set, and the second central shaft act with one another, the drive cam is driven to rotate the respective operation arm so that when the accelerator of the right-side recycle-cylinder opens, the right-side recycle-cylinder is in communication with the hydraulic tank, and the hydraulic oil in the right-side recycle-cylinder device flows into the hydraulic tank reciprocally, and related components of a left-side operation structure operate in turn.

2. The low-energy and high pressure, hydraulic, pneumatic engine as claimed in claim 1, wherein in operation, the two operation structures operate relative to each other, the two operation structures include the right-side operation structure and the left-side operation structure, wherein the right-side operation structure includes the right-side main-crankshaft device, one of the right-side main-cylinder device and the left-side main-cylinder device, one of the two fourth coupling shafts, one of the right-side recycle-crankshaft device and the left-side recycle-crankshaft device, one of two first central shafts of the right-side recycle-crankshaft device and the left-side recycle-crankshaft device, one of the right-side recycle-cylinder device and the left-side recycle-cylinder device, one of the two operation arms, one of the right-side movable-valve device and the left-side movable-valve device, one of the right-side recycle-valve device and the left-side recycle-valve, one of the right-side swing-arm device and the left-side swing-arm device, one of two cams of the right-side umbrella-shaped gear device and the left-side umbrella-shaped gear device, one of the right-side umbrella-shaped gear device and the left-side umbrella-shaped gear device, and the bevel gear; the left-side operation structure includes the left-side main-crankshaft device, the left-side main-cylinder device, the fourth coupling shaft, the left-side recycle-crankshaft device, the first central shaft, the left-side recycle-cylinder device, the left-side operation arm, the left-side movable-valve device, the left-side recycle-valve device, the left-side swing-arm device, the drive cam, the left-side umbrella-shaped gear device, and the bevel gear, wherein the right-side operation structure operates opposite to the left-side operation structure.

3. The low-energy and high pressure, hydraulic, pneumatic engine as claimed in claim 1, wherein the communication of low pressure and high pressure means behind the symmetrical shell of the first piston and the second shell of the second piston, the symmetrical shell and the second shell include the air vent communicating with a conduit configured to discharge the air, the hydraulic oil in front of the first piston and the second piston, so the high pressure is in front of the first piston and the second piston, and behind the first piston and the second piston are defined the conduit communicating with the air vent of the cylinder, wherein the low pressure forms behind the first piston and the second piston.

4. The low-energy and high pressure, hydraulic, pneumatic engine as claimed in claim 1, wherein when the second piston retracts to the lowest position from the high position, the accelerator is closed so as to isolate the pressure, wherein the right-side recycle-cylinder device and the left-side recycle cylinder device are in a no-pressure state, wherein when the piston of the right-side recycle-cylinder device or the left-side recycle cylinder device retracts to the lowest position from the high position, and the circulation space of the fluid operation is produced.

5. The low-energy and high pressure, hydraulic, pneumatic engine as claimed in claim 1, wherein a first end of the first coupling shaft of the rotational base of is connected with the bevel gear, a second end of the first coupling shaft is connected with the pressure rotating disc by using the connection tube via the switch disc, the pressure switch disc, and the circular partition, and the first coupling shaft drives the pressure rotating disc to rotate 360 degrees.

6. The low-energy and high pressure, hydraulic, pneumatic engine as claimed in claim 1, wherein the driving arm is mounted beside a first side of the third coupling shaft by using the first positioning pin, and a second side of the third coupling shaft is retained on a fourth trough of a second central hole of the pressure switch disc by way of the second positioning pin, wherein the driving arm rotates to drive the pressure switch disc to rotate through the third coupling shaft, and the multiple steel balls around the pressure switch disc roll to drive the driving arm so that the driving arm rotates the pressure switch disc, thus starting the pressure switch disc switch, wherein the two fifth orifices and the first orifice of the second central hole, the switch base, the switch disc, and the circular partition are at a central axis, and the first orifice is on a crossing position of 90 degrees.

7. The low-energy and high pressure, hydraulic, pneumatic engine as claimed in claim 1, wherein when the right-side umbrella-shaped gear device and the left-side umbrella-shaped gear device rotate to drive the drive cam of the right-side recycle-cylinder device and the left-side recycle cylinder device, respectively, the drive cam drives the right-side operation arm and the left-side operation arm respectively, and the accelerator of the recycle-cylinder device turns off so as to separate pressure between the casing device and the right-side recycle-cylinder device and the left-side recycle cylinder device.

8. The low-energy and high pressure, hydraulic, pneumatic engine as claimed in claim 1, wherein when the first piston in the right-side main-cylinder device is located at a highest position, the piston ring is located below a peripheral side of a sixth orifice, when the first piston in the right-side main-cylinder device is located at a lowest position, the piston ring is located above a ninth orifice.

* * * * *